US011223133B2

(12) United States Patent
Kim et al.

(10) Patent No.: US 11,223,133 B2
(45) Date of Patent: Jan. 11, 2022

(54) CHIP ANTENNA

(71) Applicant: Samsung Electro-Mechanics Co., Ltd., Suwon-si (KR)

(72) Inventors: Jae Yeong Kim, Suwon-si (KR); Chin Mo Kim, Suwon-si (KR); Ji Hyung Jung, Suwon-si (KR); Sung Nam Cho, Suwon-si (KR); Sung Yong An, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 39 days.

(21) Appl. No.: 16/802,798

(22) Filed: Feb. 27, 2020

(65) Prior Publication Data

US 2020/0335870 A1 Oct. 22, 2020

(30) Foreign Application Priority Data

Apr. 18, 2019 (KR) ..... 10-2019-0045556
Aug. 5, 2019 (KR) ..... 10-2019-0094915

(51) Int. Cl.
*H01Q 1/38* (2006.01)
*H01Q 9/04* (2006.01)
*H01Q 1/48* (2006.01)

(52) U.S. Cl.
CPC ..... *H01Q 9/0457* (2013.01); *H01Q 1/38* (2013.01); *H01Q 1/48* (2013.01)

(58) Field of Classification Search
CPC ..... H01Q 9/0457; H01Q 1/48; H01Q 1/38; H01Q 21/28; H01Q 9/0414; H01Q 1/243;
(Continued)

(56) References Cited

U.S. PATENT DOCUMENTS

2006/0180342 A1* 8/2006 Takaya ..... H05K 1/165 174/256
2009/0088314 A1 4/2009 Abe et al.
2018/0219281 A1 8/2018 Sudo et al.

FOREIGN PATENT DOCUMENTS

JP 2000-344571 A 12/2000
JP 2003-283239 A 10/2003
(Continued)

OTHER PUBLICATIONS

Korean Office Action dated Feb. 27, 2020 in corresponding Korean Patent Application No. 10-2019-0094915 (5 pages in English and 5 pages in Korean).

*Primary Examiner* — David E Lotter
(74) *Attorney, Agent, or Firm* — NSIP Law

(57) ABSTRACT

A chip antenna includes a first substrate, a second substrate overlapping the first substrate, a first patch, provided on a first surface of the first substrate, operating as a feed patch, a second patch, provided on the second substrate, operating as a radiation patch, at least one feed via penetrating through the first substrate in a thickness direction and configured to provide a feed signal to the first patch, and a ground pad provided on the other surface of the first substrate. The first substrate comprises a ceramic sintered material. The ceramic sintered material comprises an $Mg_2SiO_4$ phase, an $MgAl_2O_4$ phase, and a $CaTiO_3$ phase, and a content of the $CaTiO_3$ phase in the ceramic sintered material ranges from 5.1 mol % to 15.1 mol %.

15 Claims, 24 Drawing Sheets

(58) Field of Classification Search
CPC .... H01Q 1/2283; H01Q 1/50; C04B 2235/80; C04B 2235/3217; C04B 2235/77; C04B 2235/96; C04B 2235/3418; C04B 2235/3206
See application file for complete search history.

(56) References Cited

FOREIGN PATENT DOCUMENTS

| | | | |
|---|---|---|---|
| KR | 10-1515427 | B1 | 4/2015 |
| KR | 10-2018-0089853 | A | 8/2018 |
| WO | WO 2004/089049 | A1 | 10/2004 |

* cited by examiner

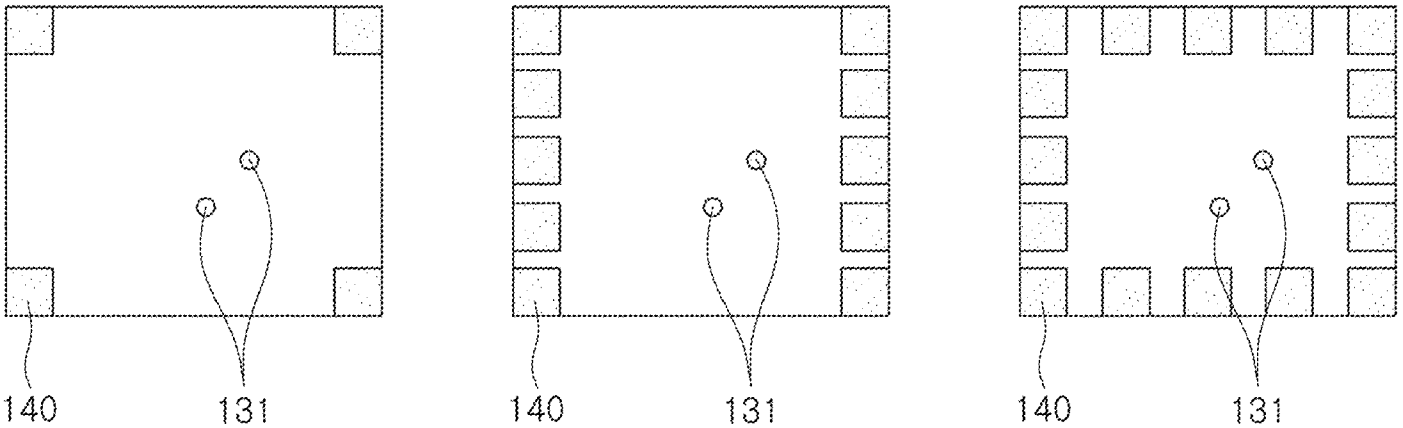
FIG. 4D–A
FIG. 4D–B
FIG. 4D–C
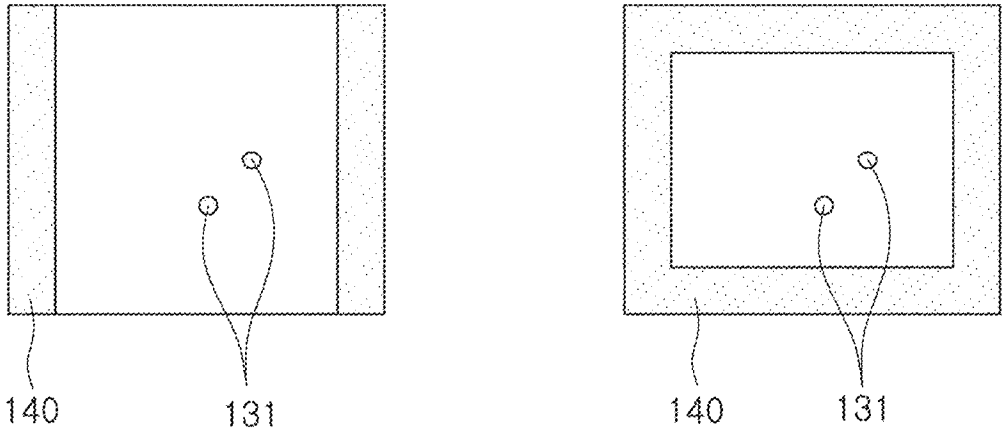
FIG. 4D–D
FIG. 4D–E
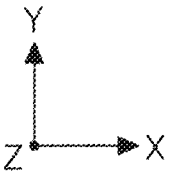

$Mg_2SiO_4$

| Element | Wt% | At% |
|---|---|---|
| CK | 01.27 | 02.17 |
| **OK** | **39.75** | **50.81** |
| **MgK** | **37.04** | **31.16** |
| AlK | 00.17 | 00.13 |
| **SiK** | **21.22** | **15.45** |
| CaK | 00.56 | 00.29 |

$MgAl_2O_4$

| Element | Wt% | At% |
|---|---|---|
| CK | 01.40 | 02.62 |
| **OK** | **42.03** | **58.84** |
| **MgK** | **28.07** | **17.65** |
| **AlK** | **23.37** | **07.23** |
| SiK | 02.61 | 02.08 |
| TiK | 02.51 | 11.58 |

$CaTiO_3$

| Element | Wt% | At% |
|---|---|---|
| CK | 02.26 | 04.74 |
| **OK** | **38.86** | **61.17** |
| MgK | 00.45 | 00.46 |
| AlK | 00.52 | 00.48 |
| **CaK** | **26.24** | **16.49** |
| **TiK** | **31.67** | **16.65** |

CHIP ANTENNA

CROSS-REFERENCE TO RELATED APPLICATION

This application claims the benefit under 35 USC 119(a) of Korean Patent Application No. 10-2019-0045556 filed on Apr. 18, 2019, and Korean Patent Application No. 10-2019-0094915 filed on Aug. 5, 2019 in the Korean Intellectual Property Office, the entire disclosures of which are incorporated herein by reference for all purposes.

BACKGROUND

1. Field

The present disclosure relates to a chip antenna.

2. Description of Related Art 5G communication systems are implemented in higher frequency bands (mmWave), between 10 GHz and 100 GHz, for example, to attain a high data transfer rate. To reduce loss of radio waves, and to increase a transmission distance, techniques such as beamforming, large-scale multiple-input multiple-output (MIMO), full dimensional multiple-input multiple-output (FD-MIMO), implementation of an array antenna, analog beamforming, and other large-scale antenna techniques have been considered in the 5G communication system.

Mobile communication terminals such as mobile phones, personal digital assistant "PDA" devices, navigation devices, laptops, and the like, which support wireless communications have been designed to have functions such as Code Division Multiple Access "CDMA", wireless Local Area Network (LAN), Digital Multimedia Broadcasting "DMB", near field communication (NFC), and similar functions. One of the main components that enable such functions is an antenna.

However, it may be difficult to use typical antennas in the GHz bands applied in 5G communication systems, since wavelengths are as small as several millimeters in the GHz bands. Thus, a small-sized chip antenna module that can be mounted on a mobile communication device and can be used in GHz bands is desired.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In a general aspect, a chip antenna includes a first substrate, a second substrate overlapping the first substrate, a first patch, provided on a first surface of the first substrate; a second patch, provided on the second substrate; at least one feed via penetrating through the first substrate in a thickness direction and configured to provide a feed signal to the first patch; and a ground pad provided on a second surface of the first substrate, wherein the first substrate comprises a ceramic sintered material, and wherein the ceramic sintered material comprises an $Mg_2SiO_4$ phase, an $MgAl_2O_4$ phase, and a $CaTiO_3$ phase, and a content of the $CaTiO_3$ phase in the ceramic sintered material ranges from 5.1 mol % to 15.1 mol %.

The first patch may be a feed patch, and the second patch may be a radiation patch.

The first substrate may have a dielectric constant of 7.5 to 15.6 at 28 GHz.

The ceramic sintered material may be a sintered material of a mixture of MgO particles, $SiO_2$ particles, $Al_2O_3$ particles, and $CaTiO_3$ particles.

A content of the $CaTiO_3$ particles in the mixture may range from 12% by weight to 33% by weight.

A content of the MgO particles in the mixture may range from 38.5 mol % to 50.2 mol %.

A content of the $SiO_2$ particles in the mixture may range from 28.0 mol % to 35.6 mol %.

A content of the $Al_2O_3$ particles in the mixture may range from 7.0 mol % to 9.1 mol %.

The second substrate may be formed of a same material as the first substrate.

A thickness of the first substrate may correspond to two to three times a thickness of the second substrate.

The first substrate may have a thickness of 150 μm to 500 μm.

The second substrate may have a thickness of 50 μm to 200 μm.

A spacer may be disposed between the first substrate and the second substrate.

A bonding layer may be disposed between the first substrate and the second substrate.

The bonding layer may have a dielectric constant lower than a dielectric constant of the first substrate and a dielectric constant of the second substrate.

In a general aspect, a chip antenna includes a first substrate, a second substrate overlapping the first substrate, a bonding layer provided on a first surface of the first substrate, and provided on a second surface of the second substrate; and wherein a dielectric constant of the bonding layer is lower than a dielectric constant of the first substrate and a dielectric constant of the second substrate.

The first substrate may include a ceramic sintered material.

The ceramic sintered material may include an $Mg_2SiO_4$ phase, an $MgAl_2O_4$ phase, and a $CaTiO_3$ phase, and a content of the $CaTiO_3$ phase in the ceramic sintered material ranges from 5.1 mol % to 15.1 mol %.

Other features and aspects will be apparent from the following detailed description, the drawings, and the claims.

BRIEF DESCRIPTION OF THE DRAWINGS

FIGS. 4D-A to 4D-E illustrate a bottom view of the example chip antenna in FIG. 4A;

FIG. 4E illustrates a perspective view illustrating a modified example of the example chip antenna in FIG. 4A;

Figure 1:
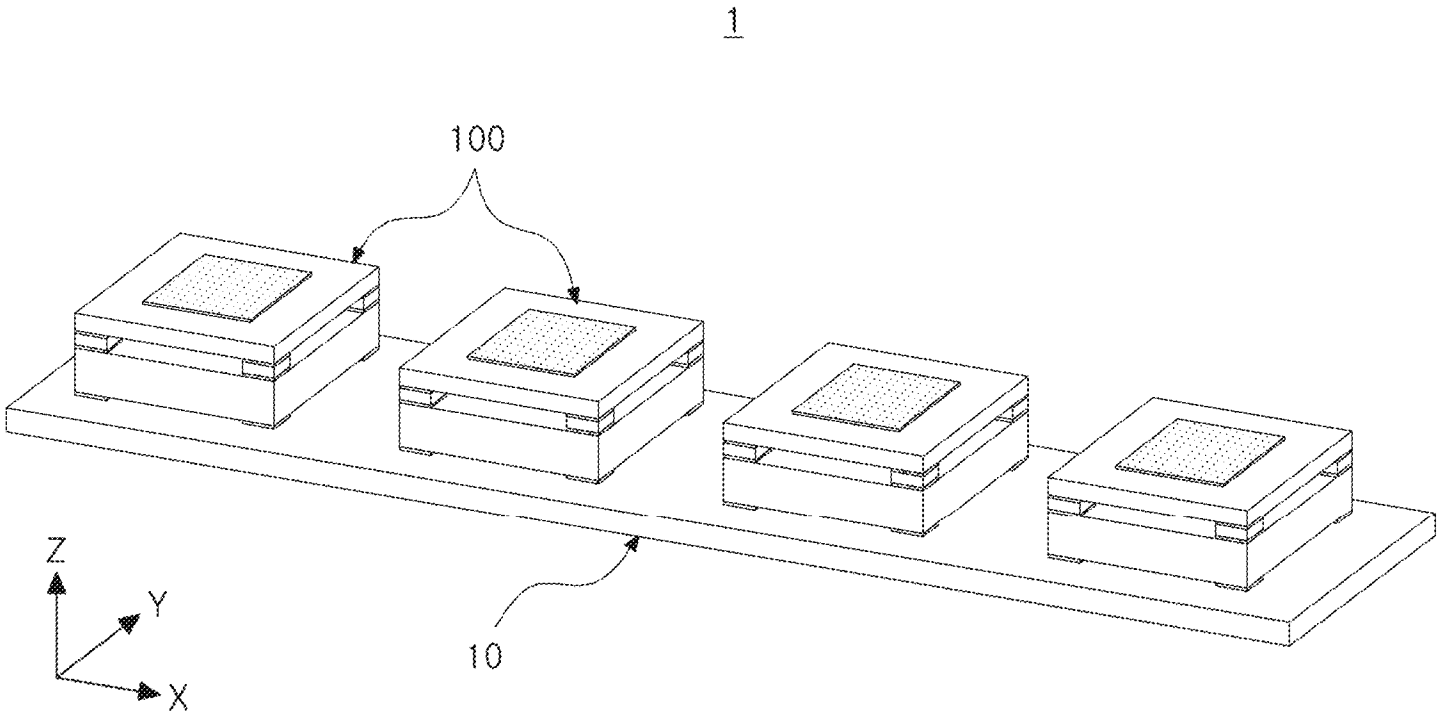
FIG. 1 illustrates a perspective view of an example chip antenna module in accordance with one or more embodiments.

Throughout the drawings and the detailed description, unless otherwise described or provided, the same drawing reference numerals will be understood to refer to the same elements, features, and structures. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known may be omitted for increased clarity and conciseness.

However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness. The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

In the drawings, the thicknesses, sizes, and shapes of lenses have been slightly exaggerated for convenience of explanation. Particularly, the shapes of spherical surfaces or aspherical surfaces illustrated in the drawings are illustrated by way of example. That is, the shapes of the spherical surfaces or the aspherical surfaces are not limited to those illustrated in the drawings.

The terms "upper side," "lower side," "side surface," and the like, in the example embodiments are based on the illustrations in the drawings, and when a direction of a respective element changes, the terms may be indicated differently.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Unless otherwise defined, all terms, including technical and scientific terms, used herein have the same meaning as commonly understood by one of ordinary skill in the art to which this disclosure pertains after an understanding of the present disclosure. Terms, such as those defined in commonly used dictionaries, are to be interpreted as having a meaning that is consistent with their meaning in the context of the relevant art and the present disclosure, and are not to be interpreted in an idealized or overly formal sense unless expressly so defined herein.

The chip antenna module in the examples, may operate in a high-frequency range, in a frequency band of 3 GHz or higher, for example. The chip antenna module in the examples may be mounted on an electronic device configured to receive, or to receive and transmit, a radio-frequency (RF) signal. For example, the chip antenna may be mounted on a portable phone, a portable laptop, a drone, but is not limited thereto. Herein, it is noted that use of the term 'may' with respect to an example or embodiment, e.g., as to what an example or embodiment may include or implement, means that at least one example or embodiment exists where such a feature is included or implemented while all examples and embodiments are not limited thereto.

Figure 2A:
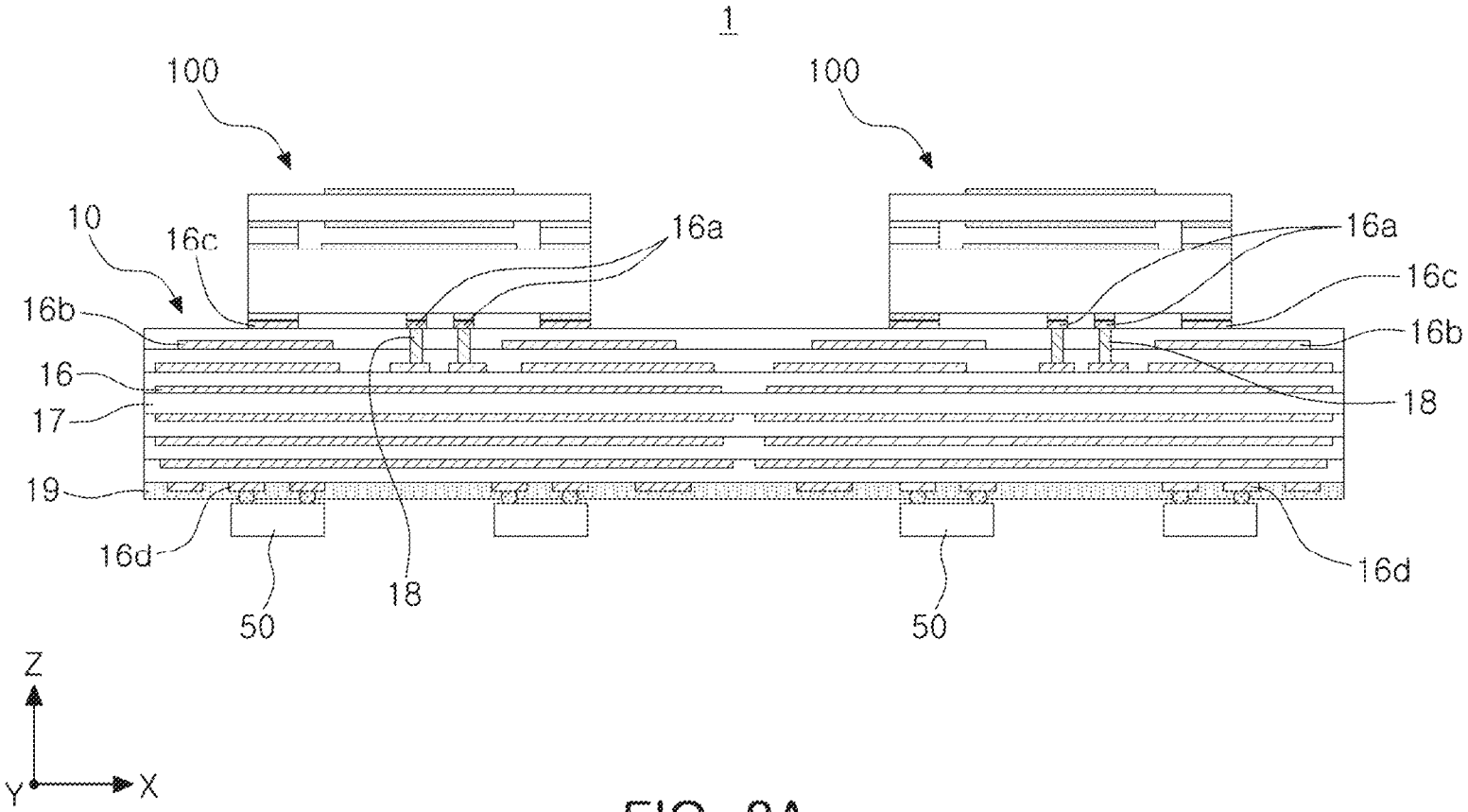
FIG. 2A is a cross-sectional view illustrating a portion of the chip antenna module in FIG. 1.
Figure 3A:
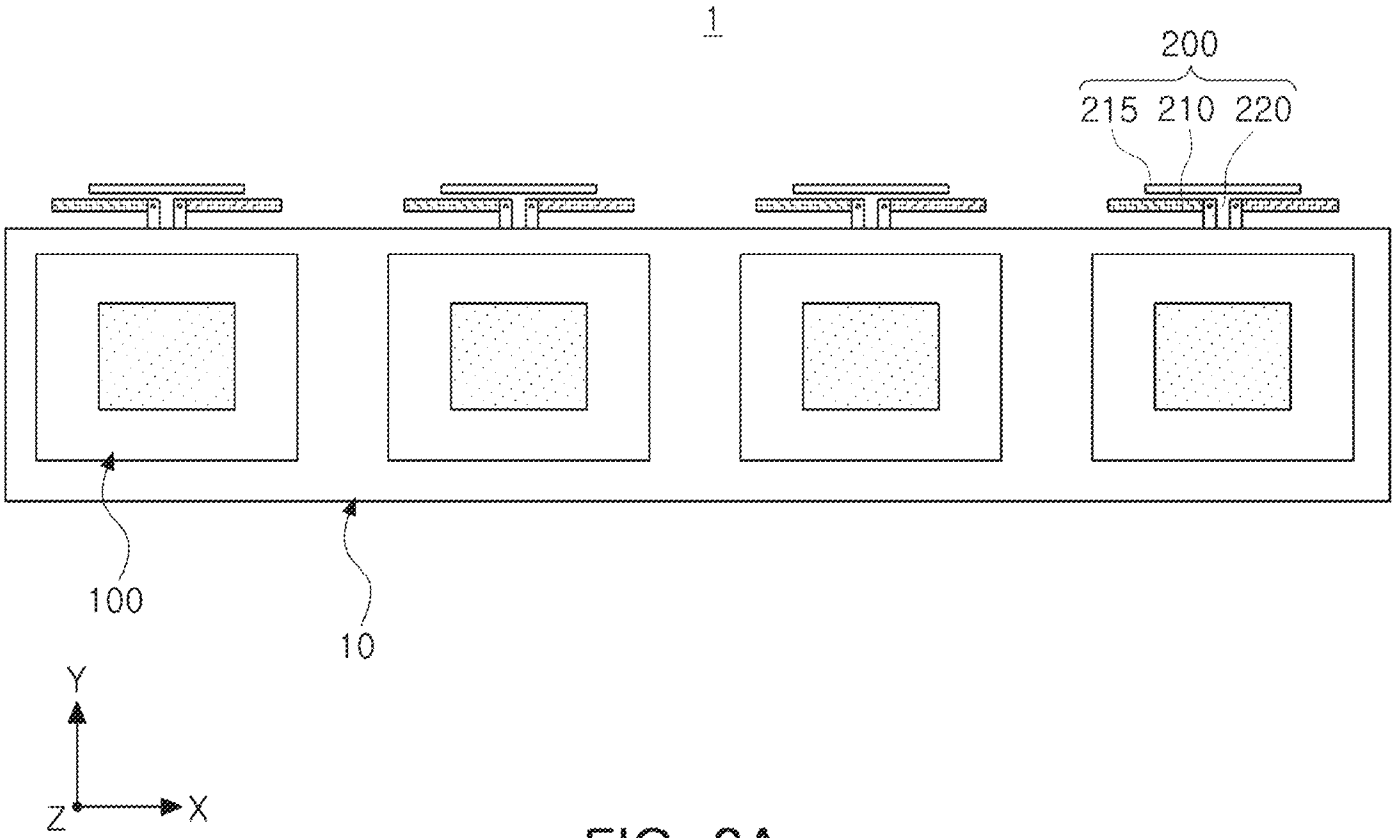
FIG. 3A illustrates a plan view of the example chip antenna module in FIG. 1.
Figure 3B:
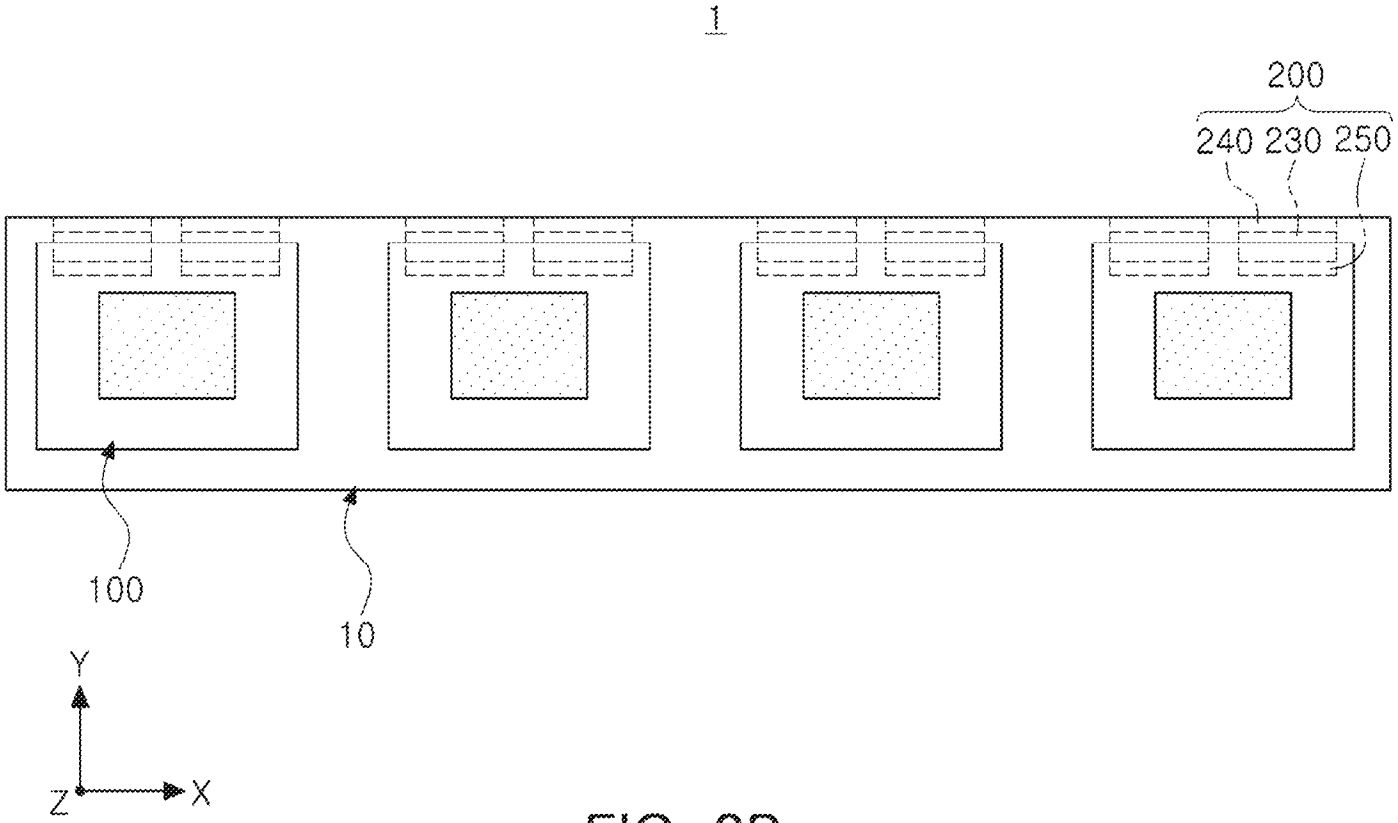
FIG. 3B illustrates a modified example of the example chip antenna module in FIG. 3A.

FIG. 1 illustrates a perspective view of a chip antenna module according an example, FIG. 2A illustrates a cross-sectional view illustrating a portion of the chip antenna module in FIG. 1, FIG. 3A illustrates a plan view of the chip antenna module in FIG. 1, and FIG. 3B illustrates a modified example of the chip antenna module in FIG. 3A.

Referring to FIGS. 1, 2A, and 3A, a chip antenna module 1 according to an example may include a substrate 10, an electronic element 50, and a plurality of chip antennas 100, and may further include at least one end-fire antenna 200. At least one electronic element 50, the plurality of the chip antennas 100, and the at least one end-fire antennas 200 may be disposed on the substrate 10.

The substrate 10 may be configured as a circuit substrate on which a circuit or an electronic component, associated with the chip antenna 100, is mounted. For example, the substrate 10 may be configured as a printed circuit board (PCB) on a surface of which one or more electronic components are mounted. Thus, the substrate 10 may include circuit wiring lines electrically connecting electronic components to each other. The substrate 10 may also be implemented as a flexible substrate, a ceramic substrate, and a glass substrate, but is not limited thereto. The substrate 10 may include a plurality of layers. For example, the substrate 10 may include a multilayer substrate formed by alternately laminating at least one insulating layer 17 and at least one wiring layer 16. The at least one wiring layer 16 may include two external layers disposed on a first surface and a second surface of the substrate 10, and at least one internal layer disposed between the two external layers. For example, the insulating layer 17 may be formed of an insulating material such as prepreg, Ajinomoto build-up film (ABF), FR-4, bismaleimide triazine (BT), but is not limited thereto. The insulating material may be formed using a thermosetting resin such as an epoxy resin, a thermoplastic resin such as a polyimide resin, a resin in which the above-described resin is impregnated in a core material such as a glass fiber (or a glass cloth or a glass fabric) together with an inorganic filler. According to examples, the insulating layer 17 may be formed of a photosensitive insulating resin.

The wiring layer 16 may electrically connect the electronic element 50, the plurality of chip antennas 100, and the plurality of end-fire antennas 200 to one another. The wiring layer 16 may also electrically connect a plurality of the electronic elements 50, the plurality of chip antennas 100, and the plurality of end-fire antennas 200 to an external entity.

The wiring layer 16 may be formed of a conductive material such as copper (Cu), aluminum (Al), silver (Ag), tin (Sn), gold (Au), nickel (Ni), lead (Pb), titanium (Ti), or alloys thereof, but is not limited thereto.

Wiring vias 18 may be disposed in the insulating layer 17 to connect the wiring layers 16 to each other.

The chip antenna 100 may be mounted on a first surface of the substrate 10, and specifically, an upper surface of the substrate 10. The chip antenna 100 may have a width extending in a Y axis direction, a length extending an X axis direction intersecting the Y axis direction, specifically, perpendicular to the Y axis direction, and a height extending in a Z axis direction. The chip antennas 100 may be arranged in an n×1 structure, as illustrated in FIG. 1. However, this is only an example, and the chip antennas 100 may be arranged in an n×m structure, where and A plurality of the chip antennas 100 may be arranged in the X axis direction. Among the plurality of chip antennas 100, two chip antennas 100 adjacent to each other in the X axis direction may oppose each other.

According to examples, the chip antennas 100 may be arranged in an n×m structure. The plurality of chip antennas 100 may be arranged in the X axis direction and the Y axis direction. Lengths of two chip antennas of the plurality of chip antennas 100, adjacent to each other in the Y axis direction, may oppose each other. Widths of two chip antennas 100, adjacent to each other in the X axis direction, may oppose each other.

Centers of the chip antennas 100, adjacent to each other in at least one of the X axis direction and the Y axis direction, may be spaced apart from each other by λ/2, λ being a wavelength of a radio-frequency (RF) signal transmitted to and received from the chip antennas 100.

When the chip antenna module 1 according to an example transmits and receives an RF signal in a band of 20 GHz to 40 GHz, the centers of the chip antennas 100, adjacent to each other, may be spaced apart from each other by 3.75 mm to 7.5 mm. When the chip antenna module 1 transmits and receives an RF signal in a band of 28 GHz, the centers of the chip antennas 100, adjacent to each other, may be spaced apart from each other by 5.36 mm.

An RF signal, used in the 5G communication system, may have a shorter wavelength and greater energy than those of the RF signal used in a 3G/4G communication system. Therefore, to significantly reduce interference between RF signals transmitted and received at the respective chip antennas 100, it is desirable that the chip antennas 100 have a sufficient separation distance.

According to an example, the centers of the chip antennas 100 are sufficiently spaced apart by λ/2 to significantly reduce interference between the RF signals transmitted and received by the respective chip antennas 100. Thus, the chip antenna 100 may be used in the 5G communication system.

According to an example, a separation distance between the centers of adjacent chip antennas 100 may be smaller than λ/2. As will be described later, each of the chip antennas 100 may be comprised of ceramic substrates and at least one patch may be provided on a portion of the ceramic substrates. In this example, the ceramic substrates may be spaced apart from each other by a predetermined distance, or a material having a lower dielectric constant than a dielectric constant of the ceramic substrates may be disposed between the ceramic substrates, thereby lowering an overall dielectric constant of the chip antenna 100. Accordingly, since the wavelength of the RF signal transmitted and received by the chip antenna 100 may be increased to improve radiation efficiency and gain, even when the adjacent chip antennas 100 are arranged such that the separation distance between centers of the adjacent chip antennas 100 is smaller than λ/2 of the RF signal, interference between RF signals may be significantly reduced. When the chip antenna module 1 according to an example transmits and receives an RF signal in a 28 GHz band, a separation distance between centers of adjacent chip antennas 100 may be smaller than 5.36 mm.

An upper surface of the substrate 10 may be provided with a feeding pad 16*a* providing a feed signal to the chip antenna 100. A ground layer 16*b* may be provided in any one internal layer among a plurality of layers of the substrate 10. As an example, the wiring layer 16 disposed on a lowermost layer in an upper surface of the substrate 10 is used as a ground layer 16*b*. The ground layer 16*b* acts as a reflector of the chip antenna 100. Therefore, the ground layer 16*b* may concentrate the RF signal by reflecting the RF signal output from the chip antenna 100 in the Z-axis direction corresponding to an oriented direction.

In FIG. 2A, the ground layer 16*b* is illustrated as being disposed on an underlying layer most adjacent to the upper surface of the substrate 10. However, according to an example, the ground layer 16*b* may be provided in the upper surface of the substrate 10 and may also be provided in other layers of the substrate 10.

Additionally, an upper surface pad 16*c* may be provided on a first surface of the substrate 10, for example, the upper surface of the substrate 10, to be bonded to the chip antenna 100. The electronic device 50 may be mounted on the second surface of the substrate 10, specifically, on the lower surface of the substrate 10. A lower surface of the substrate 10 may be provided with a lower surface pad 16*d* electrically connected to the electronic device 50.

An insulating protective layer 19 may be disposed on the lower surface of the substrate 10. The insulating protective layer 19 may be disposed in such a manner as to cover the insulating layer 17 and the wiring layer 16 on the lower surface of the substrate 10, to protect the wiring layer 16 disposed on the lower surface of the insulating layer 17. As an example, the insulating protective layer 19 may include an insulating resin and an inorganic filler. The insulating protective layer 19 may have an opening that exposes at least a portion of the wiring layer 16. The electronic device 50 may be mounted on the lower surface pad 16*d* through a solder ball disposed in the opening.

Figure 2B:
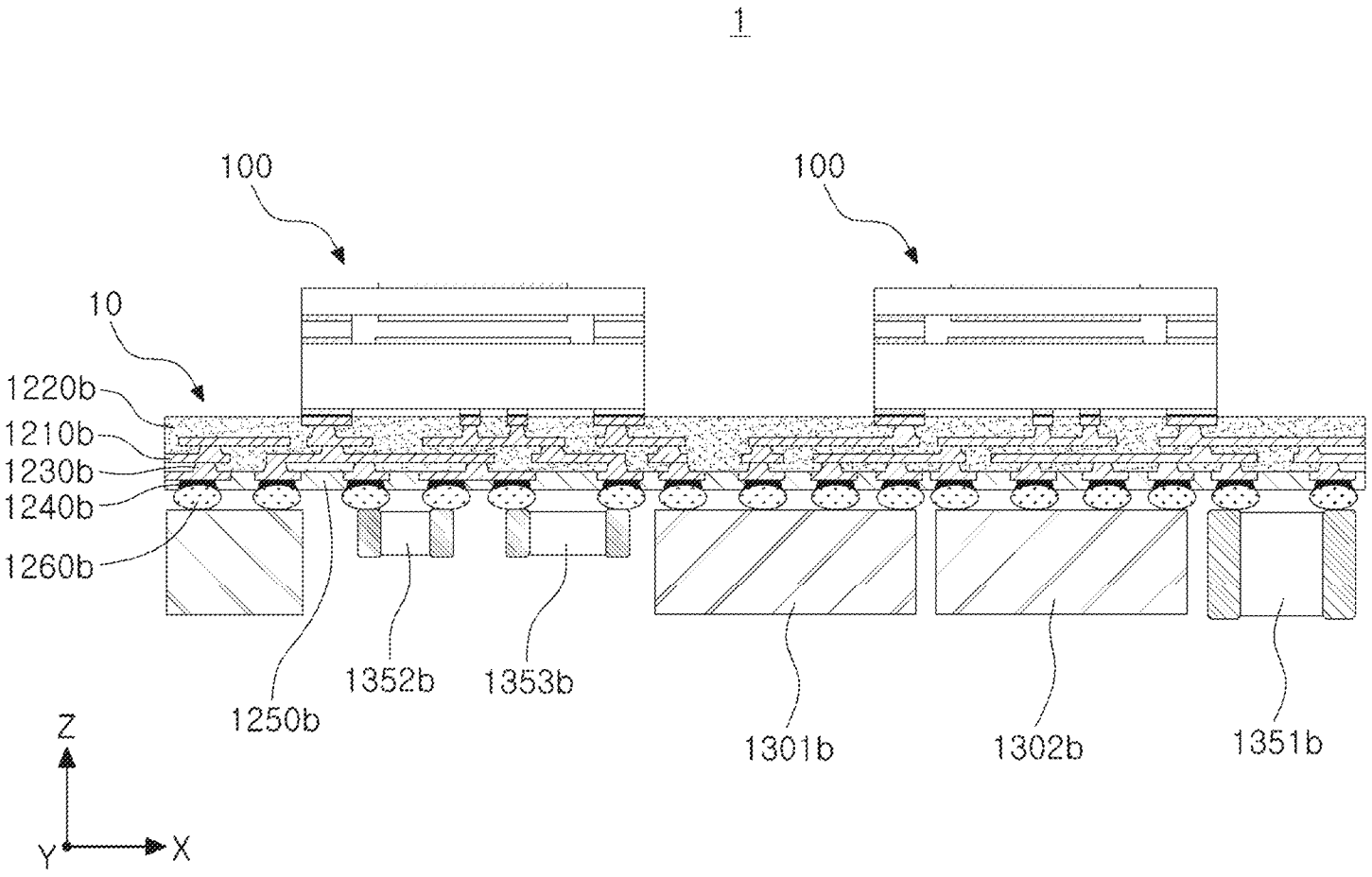
FIGS. 2B and 2C illustrate a modified example of the chip antenna module in FIG. 2A.
Figure 2C:
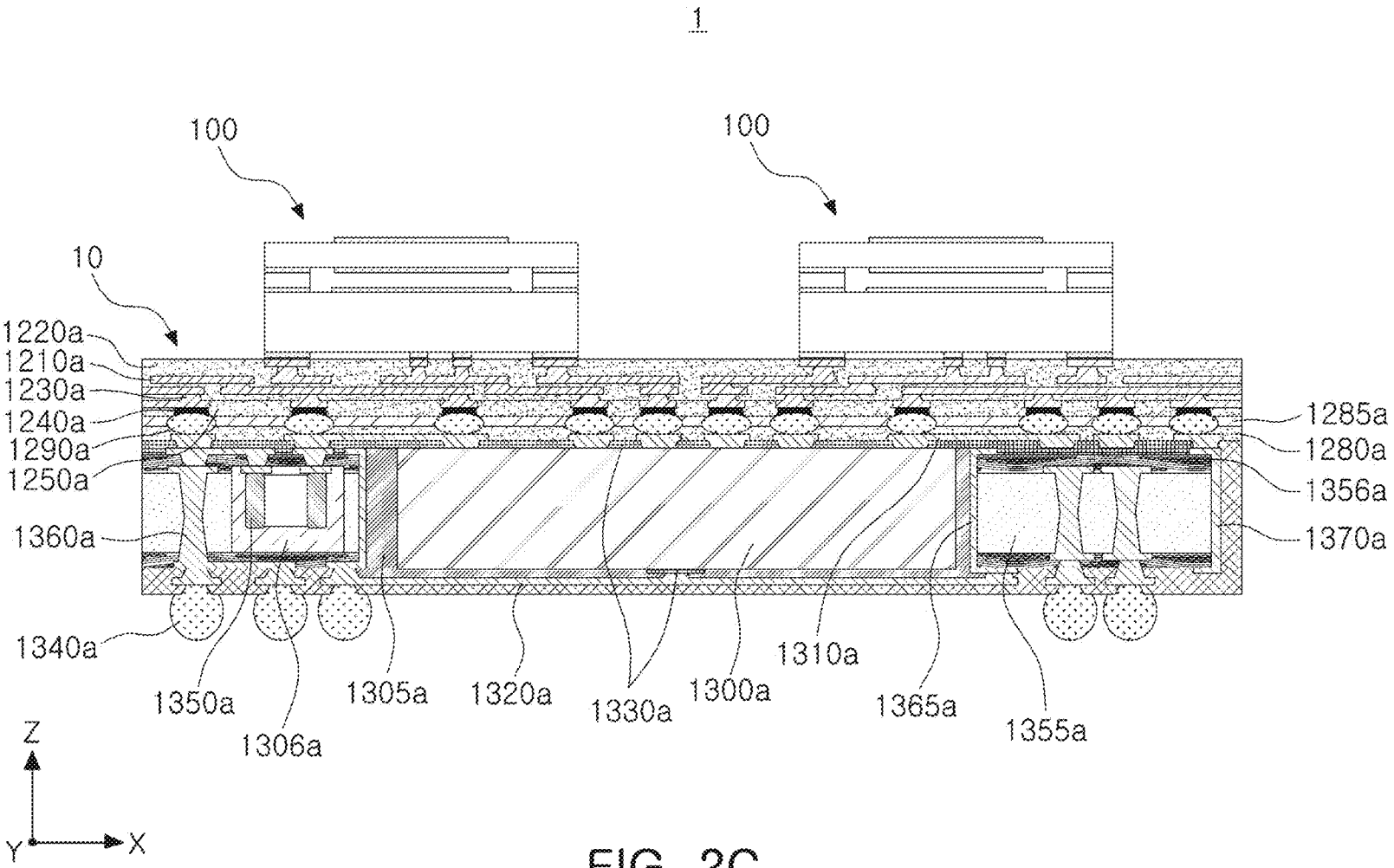

FIGS. 2B and 2C illustrate a modified example of the chip antenna module in FIG. 2A.

Since the chip antenna module according to the example in FIGS. 2B and 2C is similar to the chip antenna module in FIG. 2A, duplicate descriptions will be omitted and descriptions will focus on differences therebetween.

Referring to FIG. 2B, the substrate 10 includes at least one wiring layer 1210*b*, at least one insulating layer 1220*b*, a wiring via 1230*b* connected to at least one wiring layer 1210*b*, a connection pad 1240*b* connected to the wiring via 1230*b*, and a solder resist layer 1250*b*. The substrate 10 may have a structure similar to a copper redistribution layer (RDL). A chip antenna may be disposed on the upper surface of the substrate 10.

An IC 1301*b*, a PMIC 1302*b*, and a plurality of passive components 1351*b*, 1352*b*, and 1353*b* may be mounted on the lower surface of the substrate through a solder ball 1260*b*. The IC 1301*b* corresponds to an IC for operating the chip antenna module 1. The PMIC 1302*b* may generate power and may transfer the generated power to the IC 1301*b* through at least one wiring layer 1210*b* of the substrate 10.

The plurality of passive components 1351*b*, 1352*b* and 1353*b* may provide impedance to the IC 1301*b* and/or the PMIC 1302*b*. For example, the plurality of passive components 1351*b*, 1352*b* and 1353*b* may include at least a portion of a capacitor, such as a multilayer ceramic capacitor (MLCC) or the like, an inductor, and a chip resistor.

Referring to FIG. 2C, the substrate 10 may include at least one wiring layer 1210*a*, at least one insulating layer 1220*a*, a wiring via 1230*a*, a connection pad 1240*a*, and a solder resist layer 1250*a*.

An electronic component package may be mounted on the lower surface of the substrate 10. The electronic component package may include an IC 1300*a*, an encapsulant 1305*a* encapsulating at least a portion of the IC 1300*a*, a support member 1355*a* having a first side facing the IC 1300*a*, at least one wiring layer 1310*a* electrically connected to the IC 1300*a* and the support member 1355*a*, and a connection member including an insulating layer 1280*a*.

An RF signal, generated by the IC 1300*a*, may be transmitted to the substrate 10 through at least one wiring layer 1310*a* to be transmitted toward the upper surface of the chip antenna module 1. The RF signal, received by the chip antenna module 1, may be transmitted to the IC 1300*a* through at least one wiring layer 1310*a*.

The electronic component package may further include a connection pad 1330*a* disposed on a first surface and/or a second surface of the IC 1300*a*. The connection pad 1330*a* disposed on the first surface of the IC 1300*a* may be electrically connected to at least one wiring layer 1310*a*, and the connection pad 1330*a* disposed on the second surface of the IC 1300*a* may be electrically connected to the support member 1355*a* or a core plating member 1365*a* through a bottom wiring layer 1320*a*. The core plating member 1365*a* may provide ground to the IC 1300*a*.

The support member 1355*a* may include a core dielectric layer 1356*a* and at least one core via 1360*a* that penetrates through the core dielectric layer 1356*a* and is electrically connected to the bottom wiring layer 1320*a*. The at least one core via 1360*a* may be electrically connected to an electrical connection structure 1340*a* such as a solder ball, a pin, and a land. Accordingly, the support member 1355*a* may receive a base signal or power from the lower surface of the substrate 10 and transmit the base signal and/or power to the IC 1300*a* through the at least one wiring layer 1310*a*.

The IC 1300*a* may generate an RF signal of a millimeter wave (mmWave) band using the base signal and/or power. For example, the IC 1300*a* may receive a low frequency base signal and perform frequency conversion, amplification, filtering phase control, and power generation of the base signal. The IC 1300*a* may be formed of one of a compound semiconductor (for example, GaAs) and a silicon semiconductor to implement high frequency characteristics. The electronic component package may further include a passive component 1350*a* electrically connected to the at least one wiring layer 1310*a*. The passive component 1350*a* may be disposed in an accommodation space 1306*a* provided by the support member 1355*a*. The passive component 1350*a* may include at least a portion of a multilayer ceramic capacitor (MLCC), an inductor, and a chip resistor.

The electronic component package may include core plating members 1365*a* and 1370*a* disposed on side surfaces of the support member 1355*a*. The core plating members 1365*a* and 1370*a* may provide ground to the IC 1300*a*, and may radiate heat outwardly of the IC 1300*a* externally, or remove noise that may be introduced into the IC 1300*a*.

The configuration of the electronic component package, excluding the connection member, and the connection member may be independently manufactured and combined with each other, but may also be manufactured together. In FIG. 2C, the electronic component package is illustrated as being coupled to the substrate 10 through an electrical connection structure 1290*a* and a solder resist layer 1285*a*. However, the electrical connection structure 1290*a* and the solder resist layer 1285*a* may be omitted according to an example.

Referring to FIG. 3A, the chip antenna module 1 may further include at least one or more end-fire antennas 200. Each of the end-fire antennas 200 may include an end-fire antenna pattern 210, a director pattern 215, and an end-fire feedline 220.

The end-fire antenna pattern 210 may transmit or receive an RF signal in a lateral direction. The end-fire antenna pattern 210 may be disposed on the side of the substrate 10 and may be formed to have a dipole form or a folded dipole form, but is not limited thereto. The director pattern 215 may be electromagnetically coupled to the end-fire antenna pattern 210 to improve the gain or bandwidth of the plurality of end-fire antenna patterns 210. The end-fire feedline 220 may transmit the RF signal received from the end-fire antenna pattern 210 to an electronic device or an IC, and transmit an RF signal received from the electronic device or IC to the end-fire antenna pattern 210.

The end-fire antenna 200, formed by the wiring pattern in FIG. 3A, may be implemented as an end-fire antenna 200 having a chip shape, as illustrated in FIG. 3B.

Referring to FIG. 3B, each of the end-fire antennas 200 may include a body portion 230, a radiating portion 240, and a ground portion 250.

The body portion 230 may have a hexahedral shape and may be formed of a dielectric substance. For example, the body portion 230 may be formed of a polymer or ceramic sintered material having a predetermined dielectric constant.

The radiating portion 240 may be bonded to a first surface of the body portion 230, and the ground portion 250 may be bonded to a second surface opposing the first surface of the body portion 230. The radiating portion 240 and the ground portion 250 may be formed of the same material. The radiating portion 240 and the ground portion 250 may be formed of one selected from silver (Ag), gold (Au), copper (Cu), aluminum (Al), platinum (Pt), titanium (Ti), molybdenum (Mo), nickel (Ni), and tungsten (W), or an alloy of two or more thereof. The radiating portion 240 and the ground portion 250 may be formed to have the same shape and the same structure. The radiating portion 240 and the ground portion 250 may be distinct from each other depending on the type of the pad to be bonded when mounted on the substrate 10. For example, of the radiating portion 240 and the ground portion 250, a portion bonded to a feeding pad may function as the radiating portion 240, and a portion bonded to a ground pad may function as the ground portion 250.

Since the chip-type end-fire antenna 200 has a capacitance due to the dielectric between the radiating portion 240 and the ground portion 250, a coupling antenna may be designed or the resonant frequency may be tuned using the capacitance.

Typically, in order to secure sufficient antenna characteristics of a patch antenna implemented to have a pattern form in a multilayer substrate, a plurality of layers may be needed in the substrate. This causes a problem in which the volume of the patch antenna is excessively increased. This problem may be solved by disposing an insulator having a relatively high dielectric constant in the multilayer substrate to form a thinner insulator and by reducing the size and thickness of an antenna pattern.

However, when the dielectric constant of an insulator is increased, the wavelength of an RF signal may be shortened and the RF signal may be trapped in the insulator having a high dielectric constant. Thus, radiation efficiency and gain of the RF signal may be significantly reduced.

According to an example, a patch antenna, implemented to have a pattern form in the typical multilayer substrate, may be implemented to have a chip form. Thus, the number of layers of the substrate, on which the chip antenna is mounted, may be significantly decreased. Accordingly, the manufacturing costs and volume of the chip antenna module 1 according to the present example may be reduced.

According to an example, the dielectric constant of ceramic substrates, provided in the chip antenna 100, may be higher than a dielectric constant of an insulating layer provided in the substrate 10. Thus, miniaturization of the chip antenna 100 may be implemented to improve characteristics of the antenna 100.

Furthermore, first and second substrates of the chip antenna 100 may be spaced apart from each other by a predetermined distance. Alternately, a material, having a dielectric constant lower than a dielectric constant of the first and second substrates, may be disposed between the first and second substrates to lower an overall dielectric constant of the chip antenna 100. As a result, while miniaturizing the chip antenna module 1, the wavelength of the RF signal may be increased to improve radiation efficiency and gain.

Figure 4A:
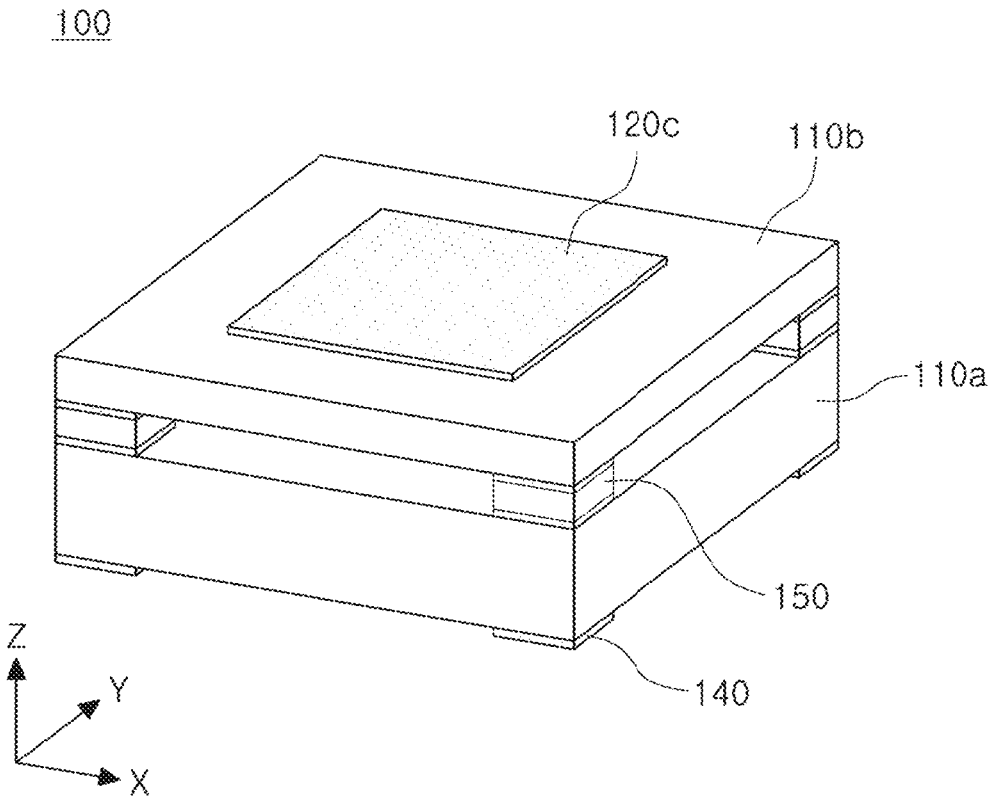
FIG. 4A illustrates a perspective view of an example chip antenna according to a first example.
Figure 4B:
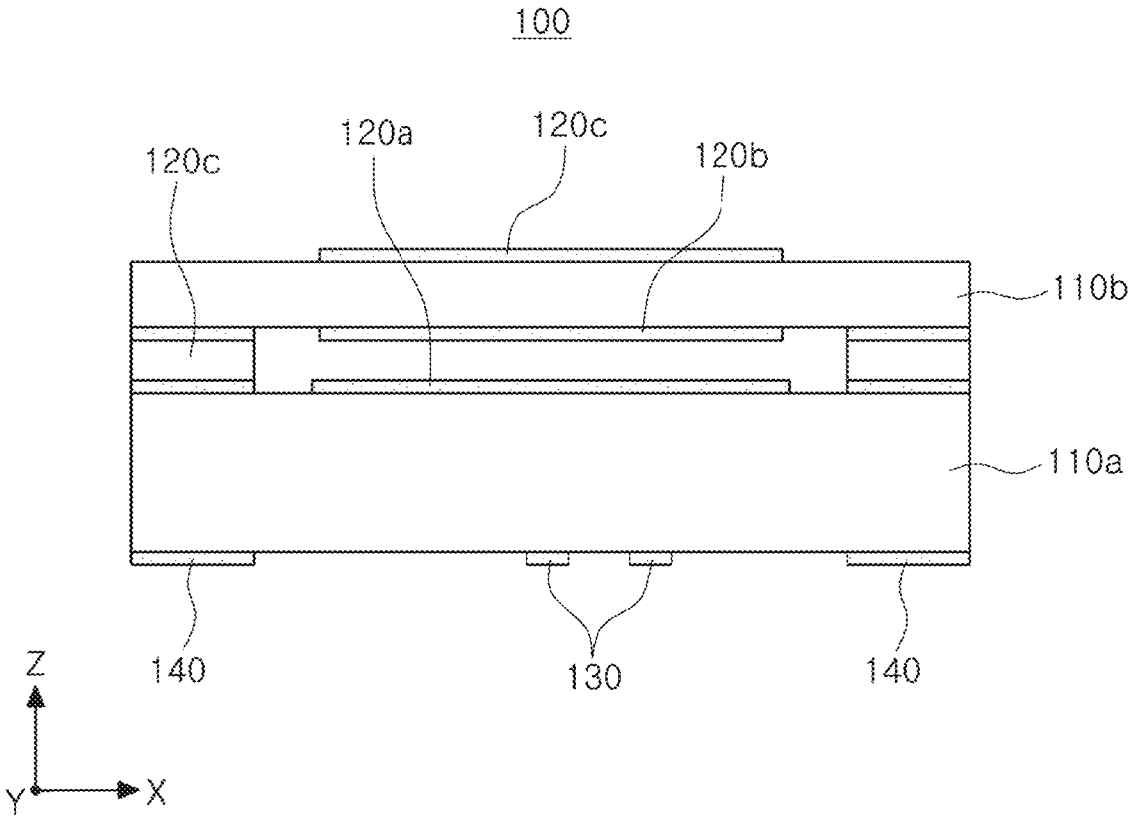
FIG. 4B illustrates a side view of the example chip antenna in FIG. 4A.
Figure 4C:
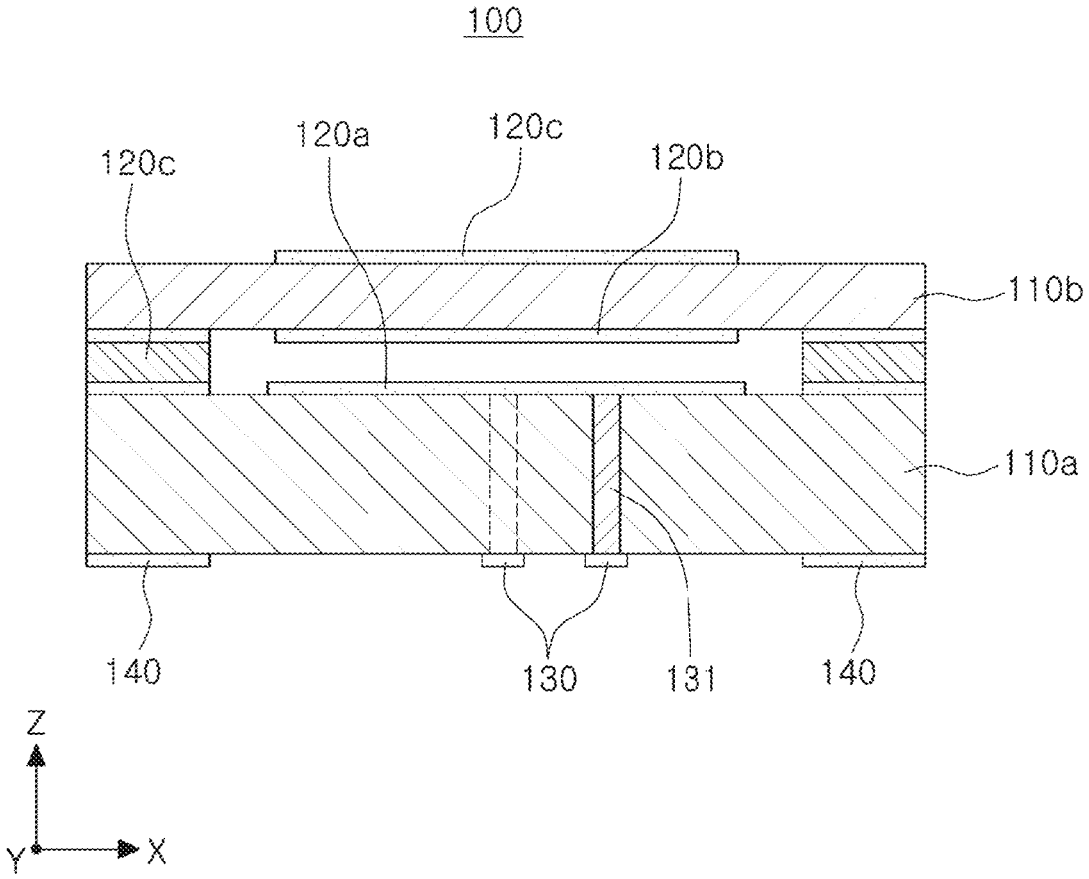
FIG. 4C illustrates a cross-sectional view of the example chip antenna in FIG. 4A.
Figure 4E:
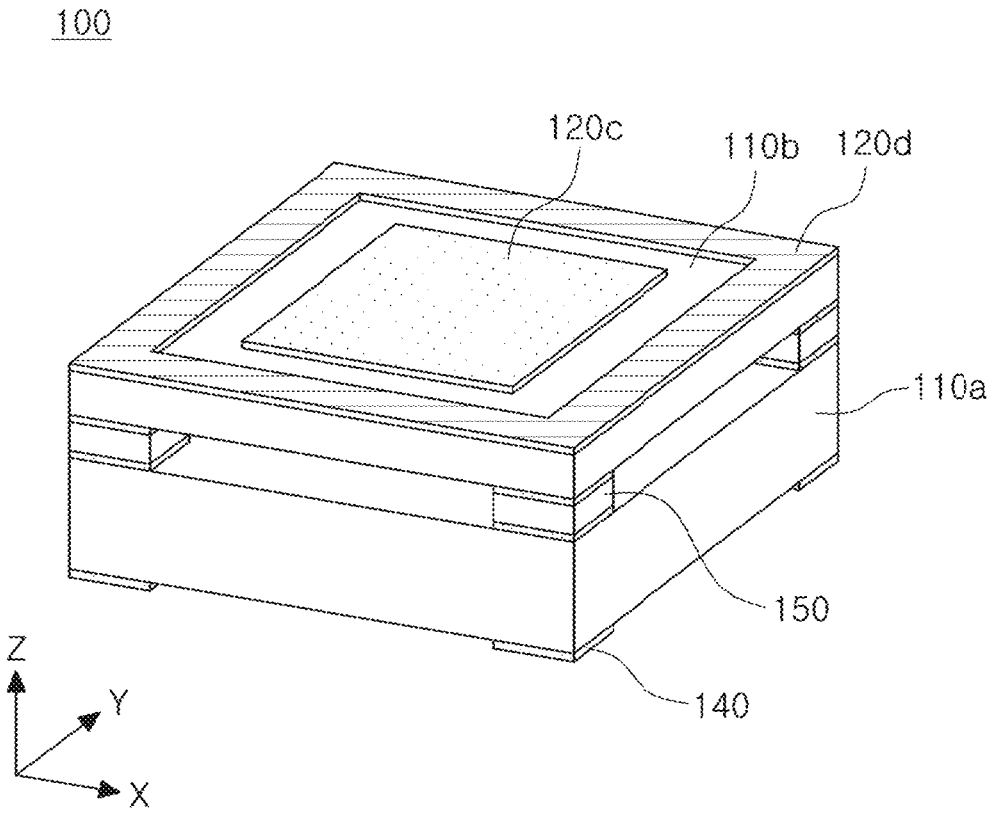

FIG. 4A is a perspective view of a chip antenna according to a first example, FIG. 4B is a side view of the chip antenna in FIG. 4A, FIG. 4C is a cross-sectional view of the chip antenna in FIG. 4A, FIG. 4D-A to 4D-E are bottom views of the chip antenna in FIG. 4A, and FIG. 4E is a perspective view illustrating a modified example of the chip antenna in FIG. 4A.

Referring to FIGS. 4A, 4B, 4C and 4D-A to 4D-E, a chip antenna 100 according to the first example may include a first substrate 110*a*, a second substrate 110*b*, and a first patch 120*a*, and may include at least one of a second patch 120*b* and a third patch 120*c*.

The first patch 120*a* may be formed of a metal having a flat plate shape having a predetermined area. The first patch 120*a* may be formed to have a quadrangular shape. According to an example, the first patch 120*a* may have various shapes such as a polygonal shape, a circular shape or the like, but is not limited thereto. The first patch 120*a* may be connected to a feed via 131 to function and operate as a feed patch.

The second patch 120*b* and the third patch 120*c* may be disposed to be spaced apart from the first patch 120*a* by a predetermined distance, and may be formed of a flat plate-shaped metal having one constant area. The second patch 120*b* and the third patch 120*c* have the same area as or a different area from the first patch 120*a*. As an example, the second patch 120*b* and the third patch 120*c* may have an area smaller area than an area of the first patch 120*a* and may be disposed on the first patch 120*a*. As an example, the second patch 120*b* and the third patch 120*c* may be formed to be 5% to 8% smaller than the first patch 120*a*. For example, each of the first patch 120*a*, the second patch 120*b*, and the third patch 120C may have a thickness of 20 μm.

The second patch 120*b* and the third patch 120*c* may be electromagnetically coupled to the first patch 120*a* to function and operate as a radiation patch. The second patch 120*b* and the third patch 120*c* may further concentrate the RF signal in the Z direction corresponding to a mounting direction of the chip antenna 100 to improve the gain or bandwidth of the first patch 120*a*. The chip antenna 100 may include at least one of the second and third patches 120*b* and 120*c* functioning as radiation patches.

The first patch 120*a*, the second patch 120*b*, and the third patch 120*c* may be formed of one selected from, but not limited to, Ag, Au, Cu, Al, Pt, Ti, Mo, Ni and W or an alloy of two or more thereof. The first patch 120*a*, the second patch 120*b*, and the third patch 120*c* may be formed of a conductive paste or a conductive epoxy.

The first patch 120*a*, the second patch 120*b*, and the third patch 120*c* may be prepared by laminating a copper foil on the substrates 110*a* and 110*b* to form electrodes and patterning the formed electrodes to have a designed shape. An etching process, such as a lithography process, may be used to pattern the electrodes. The electrodes may be formed using a subsequent electroplating process after forming a seed using an electroless plating process. Alternatively, the electrode may be formed using a subsequent electroplating process after forming a seed using a sputtering process.

Additionally, the first patch 120*a*, the second patch 120*b*, and the third patch 120*c* may be formed by printing and curing a conductive paste or a conductive epoxy on a ceramic substrate. Through a printing process, the first patch

120*a*, the second patch 120*b*, and the third patch 120*c* may be directly formed to have a predetermined shape without an additional etching process.

According to an example, each of the first patch 120*a*, the second patch 120*b*, and the third patch 120*c* may be provided with a protective layer additionally formed in the form of a film along the surface thereof. The protective layer may be formed on a surface of each of the first patch 120*a*, the second patch 120*b*, and the third patch 120*c* through a plating process. The protective layer may be formed by sequentially laminating a nickel (Ni) layer and a tin (Sn) layer, or by sequentially laminating a zinc (Zn) layer and a tin (Sn) layer. The protective layer may be formed on each of the first patch 120*a*, the second patch 120*b*, and the third patch 120*c* to prevent oxidation of the first patch 120*a*, the second patch 120*b*, and the third patch 120*c*. The protective layer may also be formed along the surfaces of a feeding pad 130, the feed via 131, a bonding pad 140, and a spacer 150 to be described later.

The first substrate 110*a* may include a ceramic sintered material, and the ceramic sintered material may include an $Mg_2SiO_4$ phase, an $MgAl_2O_4$ phase, and a $CaTiO_3$ phase. A content of the $CaTiO_3$ phase, having a high dielectric constant of approximately 170, may be tuned to obtain a dielectric constant with loss reduced at a used frequency, for example, approximately 28 GHz. The ceramic sintered material, included in the substrate 110*a*, may be a sintered material of a mixture of MgO particles, $SiO_2$ particles, $Al_2O_3$ particles, and $CaTiO_3$ particles. Since materials having the above-mentioned conditions may be included in the first substrate 110*a*, the first substrate 110*a* may have a dielectric constant of approximately 7.5 to 15.6 at 28 GHz. When the ceramic sintered material is used as a dielectric substance of the chip antenna 100, the ceramic sintered material may reduce losses while maintaining a constant dielectric at a millimeter (mm) wavelength communications band.

In an example, a dielectric substance for implementing a dielectric constant in a range of 7.5 to 15.6 (based on approximately 28 GHz), and aimed at a dielectric constant of 8.6 in the range, is desirable. Specifically, a content of an MgO component is approximately 33% by weight, a content of an $SiO_2$ component is approximately 35% by weight, a content of an $Al_2O_3$ component is approximately 15% by weight, and a content of a $CaTiO_3$ component is approximately 17% by weight. The above-mentioned components are mixed in the form of particles and then annealed to form a sintered material. When the sintered material is subjected to a calcination process, MgO and $SiO_2$ are formed to have two phases of $Mg_2SiO_4$ and $MgAl_2O_4$, and $CaTiO_3$ is independently present. Accordingly, the three phases may be distinguished from each other in the ceramic sintered material.

Figure 5:
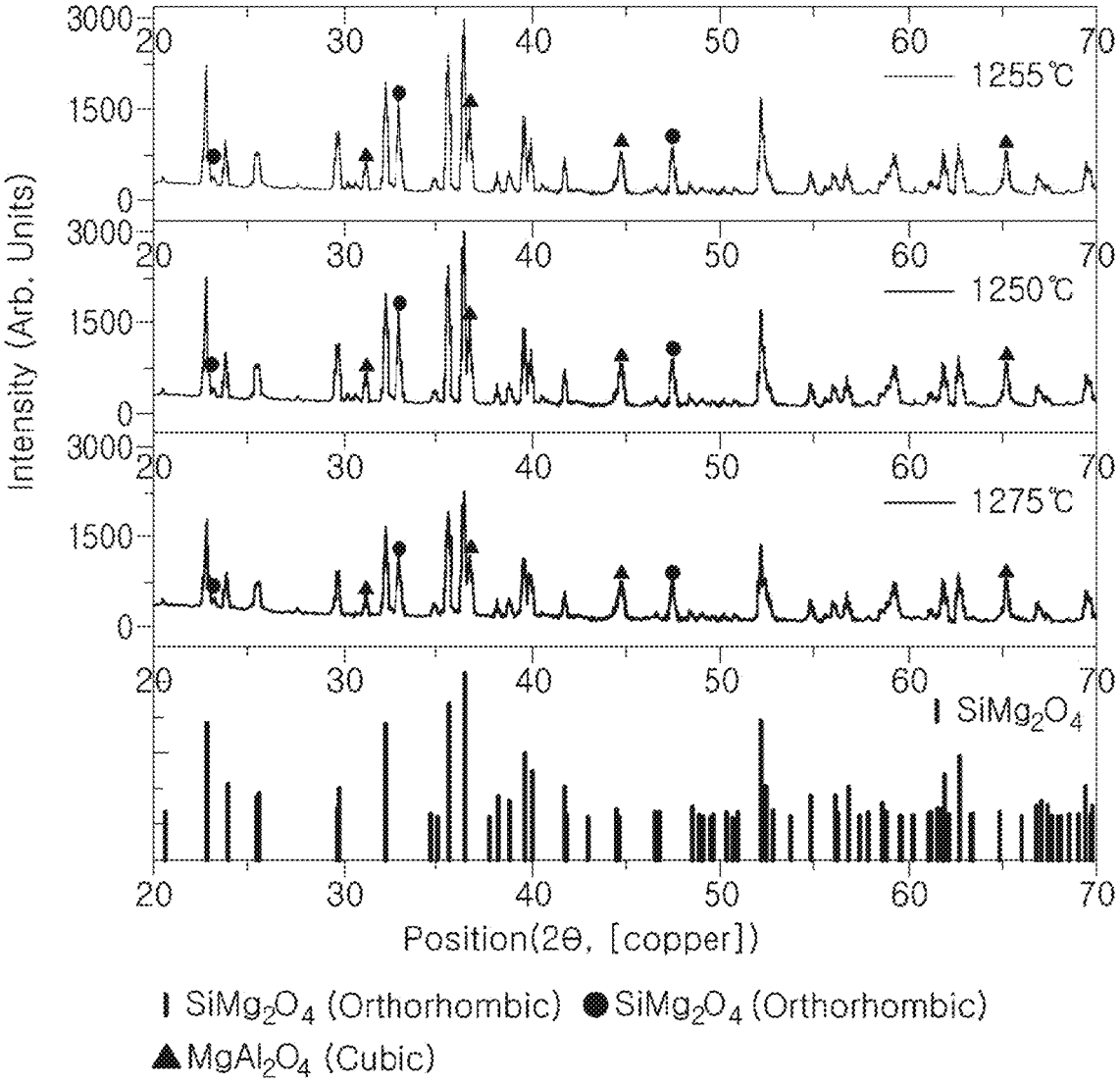
FIG. 5 illustrates an X-ray diffraction (XRD) graph showing an element analysis result of a ceramic sintered material depending on a sintering temperature.
Figure 6A:
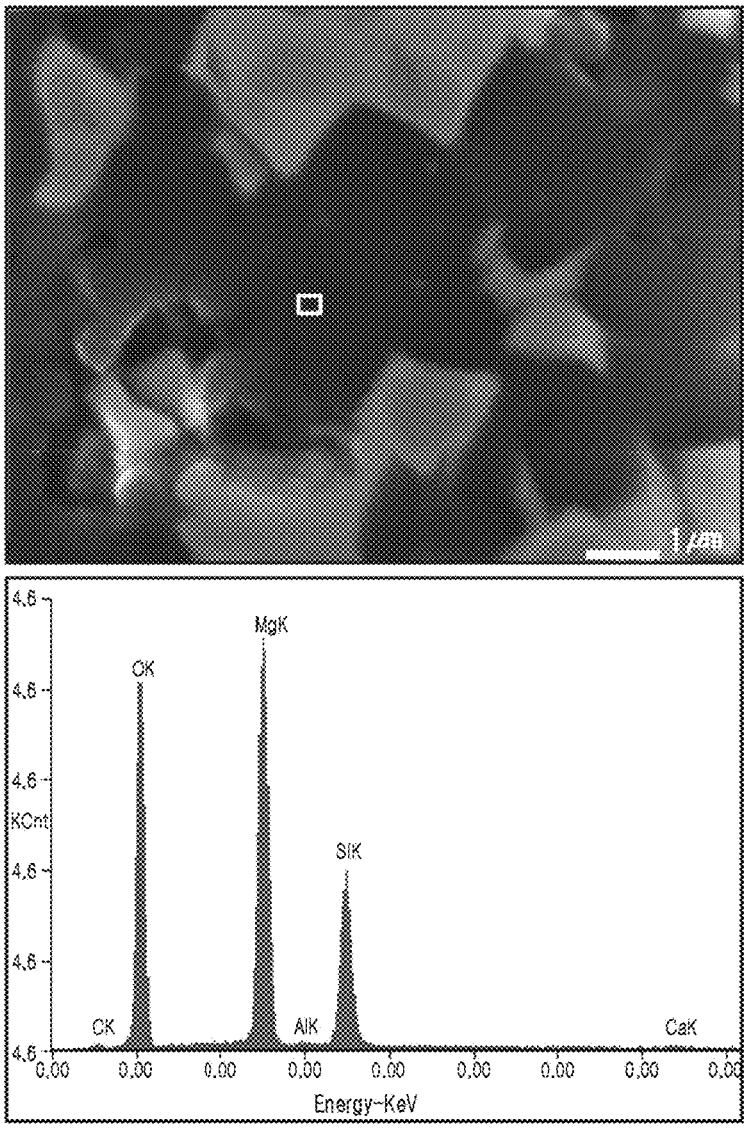
FIGS. 6A to 6C illustrate SEM images and element analysis results of a ceramic sintered material.
Figure 6B:
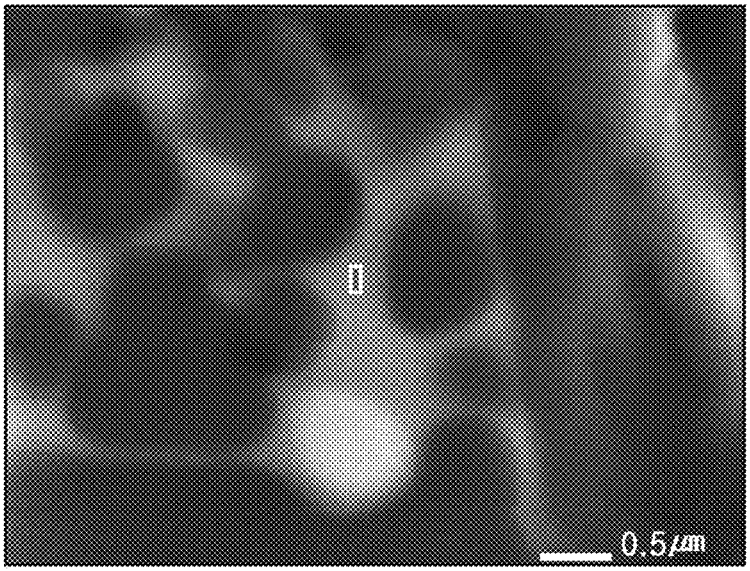
Figure 6B:
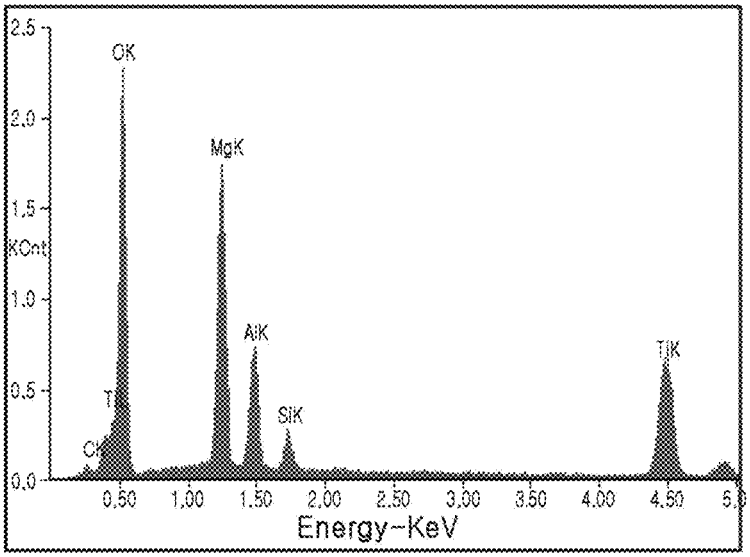
Figure 6C:
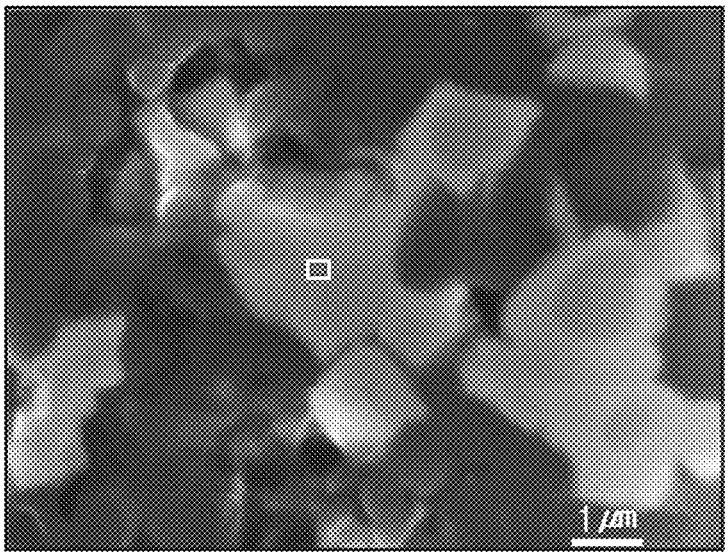
Figure 6C:
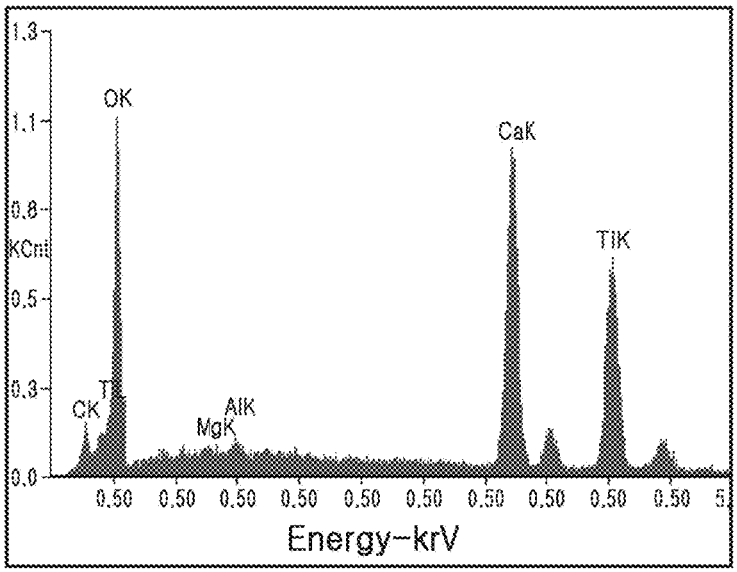

In FIG. 5, an X-ray diffraction (XRD) graph shows an element analysis result of a ceramic sintered material depending on a sintering temperature, and FIG. 6 illustrates SEM images and element analysis results of a ceramic sintered material. As can be seen from the results of FIGS. 5 and 6, the ceramic sintered material may be divided into three regions. For example, the ceramic sintered material includes an $Mg_2SiO_4$ phase, an $MgAl_2O_4$ phase, and a $CaTiO_3$ phase. These phases are not mixed with each other but are present as distinguished phases.

In this example, among the above-mentioned phases appearing in the ceramic sintered material, $CaTiO_3$ has the greatest effect on the dielectric constant. Generally, $CaTiO_3$ is a material having a dielectric constant of approximately 170 and is difficult to be used in a radio-frequency region. However, a ratio of $CaTiO_3$ in the ceramic sintered material may be tuned to implement a dielectric constant of the ceramic sintered material at an intended level. For example, the dielectric constant may be finely tuned by changing the ratio of $CaTiO_3$ among powder particles constituting the dielectric substance for obtaining the ceramic sintered material. At a frequency of approximately 28 GHz, a content of $CaTiO_3$ in total mixed powder particles may range from approximately 12% by weight to approximately 33% by weight such that a dielectric constant ranges from approximately 7.5 to approximately 15.6. It was confirmed that the dielectric substance, having such content conditions, was a low-loss material of 0.001 or less.

Table 1 illustrates a test result of variation in a dielectric constant and loss (tan δ) of the ceramic sintered material depending on $CaTiO_3$.

TABLE 1

| Overall Content (wt %) of MgO, $SiO_2$, and $Al_2O_3$ | Content (wt %) of $CaTiO_3$ | Dielectric Constant (28 GHz) | tanδ (28 GHz) |
|---|---|---|---|
| 88 | 12 | 7.5 | 0.0007 |
| 83 | 17 | 8.6 | 0.0006 |
| 79 | 21 | 10.8 | 0.0007 |
| 75 | 25 | 12.9 | 0.0004 |
| 72 | 28 | 13.9 | 0.0004 |
| 69 | 31 | 14.8 | 0.0004 |
| 67 | 33 | 15.6 | 0.0004 |

To summarize the test result, it was confirmed that a content of $CaTiO_3$ in the dielectric substance for obtaining the ceramic sintered material may be tuned in a range from 12% by weight to 33% by weight to adjust a dielectric constant in a ranging from 7.5 to 15.6. In this case, the total content of MgO, $SiO_2$, and $Al_2O_3$ may be tuned from 83% by weight to 69% by weight, and a relative ratio of MgO, SiO2, and Al2O3 was maintained at a constant level. In Table 2, a content of each element is expressed as a molar ratio (mol %) in the test result. Compositions, in which molar ratios of $CaTiO_3$ are 5.1 mol %, 7.5 mol %, 9.2 mol %, 11.0 mol %, 12.3 mol %, 13.7 mol %, and 15.1 mol %, corresponds to 12% by weight, 17% by weight, 21% by weight, 25% by weight, 28% by weight, 31% by weight, and 33% by weight, respectively.

TABLE 2

| Component (mol %) | | | | Dielectric Constant | Tanδ |
|---|---|---|---|---|---|
| MgO | $SiO_2$ | $Al_2O_3$ | $CaTiO_3$ | (28 GHz) | (28 GHz) |
| 50.2 | 35.6 | 9.1 | 5.1 | 7.5 | 0.0007 |
| 48.9 | 34.8 | 8.8 | 7.5 | 8.6 | 0.0006 |
| 46.6 | 33.1 | 8.4 | 9.2 | 10.8 | 0.0007 |
| 44.5 | 31.6 | 8.0 | 11.0 | 12.9 | 0.0004 |
| 42.5 | 30.3 | 7.6 | 12.3 | 13.9 | 0.0004 |
| 40.8 | 29.0 | 7.3 | 13.7 | 14.8 | 0.0004 |
| 38.5 | 28.0 | 7.0 | 15.1 | 15.6 | 0.0004 |

In the other elements except $CaTiO_3$, an element constituting cordierite and forsterite has a dielectric constant of approximately 4.9. In the case of the other elements, a ratio of MgO, $SiO_2$, and $Al_2O_3$ may have a mixing ratio of approximately 53.13 mol %, 37.42 mol %, and 9.45 mol % to maintain a mixed state $CaTiO_3$. When 53.13 mol %, 37.42 mol %, and 9.45 mol % are converted to percent by weight, they correspond to 40% by weight, 42% by weight, and 18% by weight, respectively. However, the ratio of MgO, $SiO_2$, and $Al_2O_3$ may be changed to tune characteristics such as a dielectric constant and the like.

To summarize the above-described result, the ceramic sintered material, included in the substrate 110*a*, may be a sintered material of a mixture of MgO particles, $SiO_2$ particles, $Al_2O_3$ particles, and $CaTiO_3$ particles, as described above. In this case, a content of the $CaTiO_3$ particles in the mixture may be 12% by weight to 33% by weight, a content of the MgO particles in the mixture may be 38.5 mol % to 50.2 mol %, a content of the $SiO_2$ particles in the mixture may be 28.0 mol % to 35.6 mol %, and a content of the $Al_2O_3$ particles in the mixture may be 7.0 mol % to 9.1 mol %.

As described above, the dielectric constant may be finely tuned by implementing a chip antenna using a dielectric substance for the first substrate 110*a* proposed in the present example. Thus, the degree of freedom in antenna design may be increased. When the degree of freedom in antenna design is increased, a length of the antenna may be effectively reduced.

Similar to the first substrate 110*a*, the second substrate 110*b* may include a dielectric substance and a magnetic substance. However, this is only an example, and the second substrate 110*b* may include only a dielectric substance. When the second substrate 110*b* includes a dielectric substance and a magnetic substance, the second substrate 110*b* may be formed of the same material as the first substrate 110*a*. Accordingly, the first and second substrates 110*a* and 110*b* may be efficiently prepared.

As illustrated, the second substrate 110*b* may have a thickness less than a thickness of the first substrate 110*a*. The thickness of the first substrate 110*a* may correspond to 1 to 5 times the thickness of the second substrate 110*b*, specifically, 2 to 3 times. For example, the thickness of the first substrate 110*a* may be 150 μm to 500 μm, and the thickness of the second substrate 110*b* may be 100 to 200 μm, in detail, 50 to 200 μm. Unlike the above-described example, the second substrate 110*b* may have the same thickness as the first substrate 110*a*.

When a distance between the ground layer 16*b* of the chip antenna module 1 and the first patch 120*a* of the chip antenna 100 corresponds to λ/10 to λ/20, the ground layer 16*b* may efficiently reflect an RF signal output from the chip antenna 100 in an oriented direction.

When the ground layer 16*b* is provided on the upper surface of the substrate 10, the distance between the ground layer 16*b* of the chip antenna module 1 and the first patch 120*a* of the chip antenna 100 is substantially equal to the sum of the thickness of the first substrate 110*a* and the thickness of the bonding pad 140.

Accordingly, the thickness of the first substrate 110*a* may be determined depending on a designed distance λ/10 to λ/20 between the ground layer 16*b* and the first patch 120*a*. As an example, the thickness of the first substrate 110*a* may correspond to 90 to 95% of λ/10 to λ/20. As an example, when the dielectric constant of the first substrate 110*a* is 5 to 12 at 28 GHz, the thickness of the first substrate 110*a* may be 150 to 500 μm.

Referring to FIG. 4C, a first surface, for example, an upper surface, of the first substrate 110*a* may be provided with a first patch 120*a*, and a second surface, for example, a lower surface, of the first substrate 110*a* may be provided with a feeding pad 130. At least one feeding pad 130 may be provided on the second surface of the first substrate 110*a*. The feeding pad 130 may have a thickness of 20 μm, but this is not so limited.

The feeding pad 130, provided on the second surface of the first substrate 110*a*, is electrically connected to the feeding pad 16*a* provided on the first surface of the substrate 10. The feeding pad 130 may be electrically connected to the feed via 131 penetrating through the first substrate 110*a* in a thickness direction, and the feed via 131 may provide a feed signal to a first patch provided on the first surface of the first substrate 110*a*. The feed signal may be provided to the first substrate 110*a*. At least one feed via 131 may be provided. For example, two feed vias 131 may be provided to correspond to two feeding pads 130. One feed via 131 of the two feed vias 131 corresponds to a feed line for generating vertical polarization, and the other feed via 131 corresponds to a feed line for generating horizontal polarization. The feed via 131 may have a diameter of 150 μm. A bonding pad 140 is provided on the other surface of the first substrate 110*a*. The bonding pads 140, provided on the second surface of the first substrate 110*a*, may be bonded to the upper surface pad 16*c* provided on the first surface of the substrate 10. For example, the bonding pad 140 of the chip antenna 100 may be bonded to the upper surface pad 16*c* of the substrate 10 through a solder paste. The bonding pad 140 may have a thickness of 20 μm, but is not so limited.

Referring to FIG. 4D-A, a plurality of bonding pads 140 may be provided at respective corners having a rectangular shape on the second surface of the first substrate 110*a*.

Referring to FIG. 4D-B, the plurality of bonding pads 140 may be spaced apart from each other by a predetermined distance along a first side of the rectangular shape of the first substrate 110*a*, and the second side opposing the first side of the first substrate 110*a*.

Referring to FIG. 4D-C, the plurality of bonding pads 140 may be provided on the second surface of the first substrate 110*a* to be spaced apart from each other by a predetermined distance along each of the four sides of a rectangular shape.

Referring to FIG. 4D-D, the bonding pad 140 may be provided to have lengths corresponding to a first side, having a rectangular shape, and the second side, opposing the first side, along the first side and the second side on the second surface of the first substrate 110*a*.

Referring to FIG. 4D-E, the bonding pad 140 may be provided to have lengths corresponding to four sides along each of the four sides, having a rectangular shape, on the second surface of the first substrate 110*a*.

In FIGS. 4D-A, 4D-B, and 4D-C, the bonding pad 140 is illustrated as having a rectangular shape. However, this is only an example, and the bonding pad 140 may be formed to have various shapes such as a circle. Additionally, in FIGS. 4D-A, 4D-B, 4D-C, 4D-D, and 4D-E, the bonding pad 140 is illustrated as being disposed adjacent to four sides of a rectangular shape. However, in an example, the bonding pad 140 may be spaced apart from the four sides by a predetermined distance.

Referring to FIG. 4E, one surface of the second substrate 110*b* may be provided with a shielding electrode 120*d* insulated from the third patch 120*c* to be formed along an edge region of the second substrate 110*b*. The shielding electrode 120*d* may reduce interference between the chip antennas 100 when the chip antennas 100 are arranged in an n×1 array, or the like. Accordingly, when the chip patch antenna 100 is arranged in a 4×1 array, the chip antenna module 1 according to an example may be manufactured as a small-sized module having a length of 19 mm, a width of 4.0 mm, and a height of 1.04 mm.

The first substrate 110*a* and the second substrate 110*b* may be spaced apart from each other through a spacer 150. The spacer 150 may be provided on each corner of the rectangular shape of the first substrate 110*a* or the second substrate 110*b*, and may be positioned between the first substrate 110*a* and the second substrate 110*b*. In an example, the spacer 150 may be provided on a first side at a central portion of the rectangular shape of the first substrate 110*a* or the second substrate 110*b*. In an example, the spacer 150 may be provided on four sides of the first substrate 110*a* or the second substrate 110*b*. Thus, the second substrate 110 may be stably supported above the first substrate 110*a*. Accordingly, a gap may be formed between the first patch 120*a*, provided on a first surface of the first substrate 110*a*, and the second patch 120*b* provided on a second surface of the second substrate 110*b* by the spacer 150. As air, having a dielectric constant of 1, fills a space formed by the gap, an overall dielectric constant of the chip antenna 100 may be lowered.

FIGS. 7A to 7F are process diagrams illustrating a method of manufacturing the chip antenna according to the first example. In FIGS. 7A to 7F, a single chip antenna is illustrated as being separately manufactured. However, according to an example, after a plurality of chip antennas are integrally formed by implementing a manufacturing method to be described later, the plurality of integrally formed chips may be divided into individual chip antennas using a cutting process.

Figure 7A:
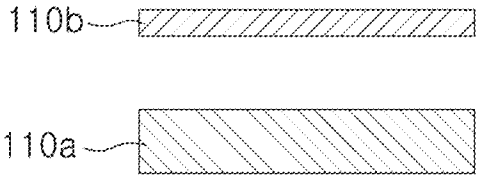
FIGS. 7A to 7F illustrate process diagrams of a method of manufacturing the example chip antenna according to the first example.
Figure 7B:
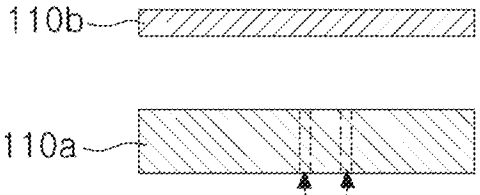
Figure 7C:
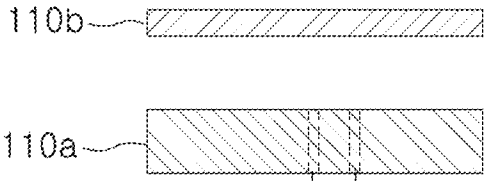

Referring to FIGS. 7A to 7F, a method of manufacturing a chip antenna according to an example starts in FIG. 7A with a first substrate 110*a* and a second substrate 110*b* being provided. Then, in FIG. 7B, a via hole VH is formed to penetrate through the first substrate 110*a* in a thickness direction. In FIG. 7C, a conductive paste is applied to, or fills, the via hole VH to form a feed via 131. The conductive paste may fill the entire via hole VH, or may be applied to an internal surface of the via hole VH to have a predetermined thickness.

Figure 7D:
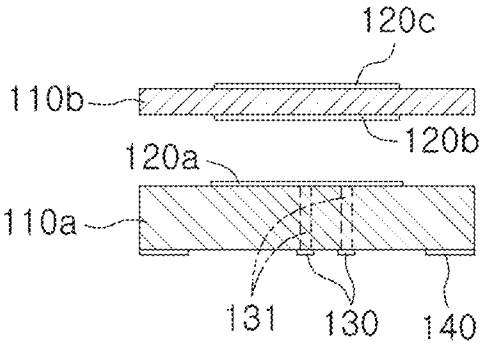

Referring to FIG. 7D, after the feed via 131 is formed, a conductive paste or a conductive epoxy is printed and cured on the first substrate 110*a* and the second substrate 110*b* to form a first patch 120*a* on a first surface of the first substrate 110*a*, to form a feeding pad 130 and a bonding pad 140 on the second surface of the first substrate 110*a*, to form a second patch 120*b* on a second surface of the second substrate 110*b*, and to form a third patch 120*c* on a first surface of the second substrate 110*b*.

Figure 7E:
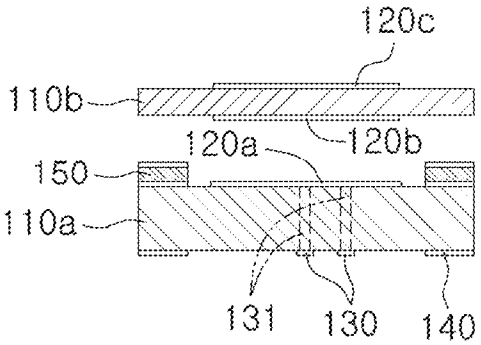
Figure 7F:
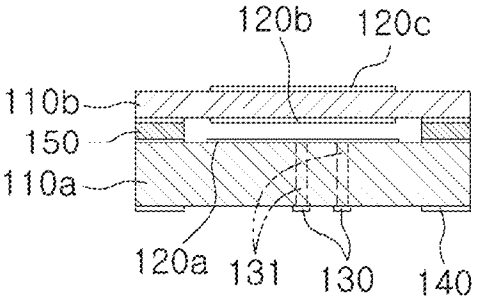

Then, as illustrated in FIG. 7E, a conductive paste or a conductive epoxy is thick film-printed and cured on an edge of a first surface of the first substrate 110*a* to form a spacer 150.

Referring to FIG. 7E, after the spacer 150 is formed, the conductive paste or the conductive epoxy is additionally printed one or more times in a region in which the spacer 150 is formed. Before curing the additionally printed conductive paste or conductive epoxy, the second substrate 110*b* is pressed with the spacer 150. After curing the conductive paste or the conductive epoxy provided in the region in which the spacer 150 is formed, a protective layer is formed by implementing a plating process on the first patch 120*a*, the second patch 120*b*, the third patch 120*c*, the feeding pad 130, the feed via 131, the bonding pad 140, and the spacer 150. The protective layer may prevent oxidation of the first patch 120*a*, the second patch 120*b*, the third patch 120*c*, the feeding pad 130, the feed via 131, the bonding pad 140, and the spacer 150. Then, the plurality of integrally formed chip antennas may be separated by implementing a cutting process to manufacture individual chip antennas.

Figure 8A:
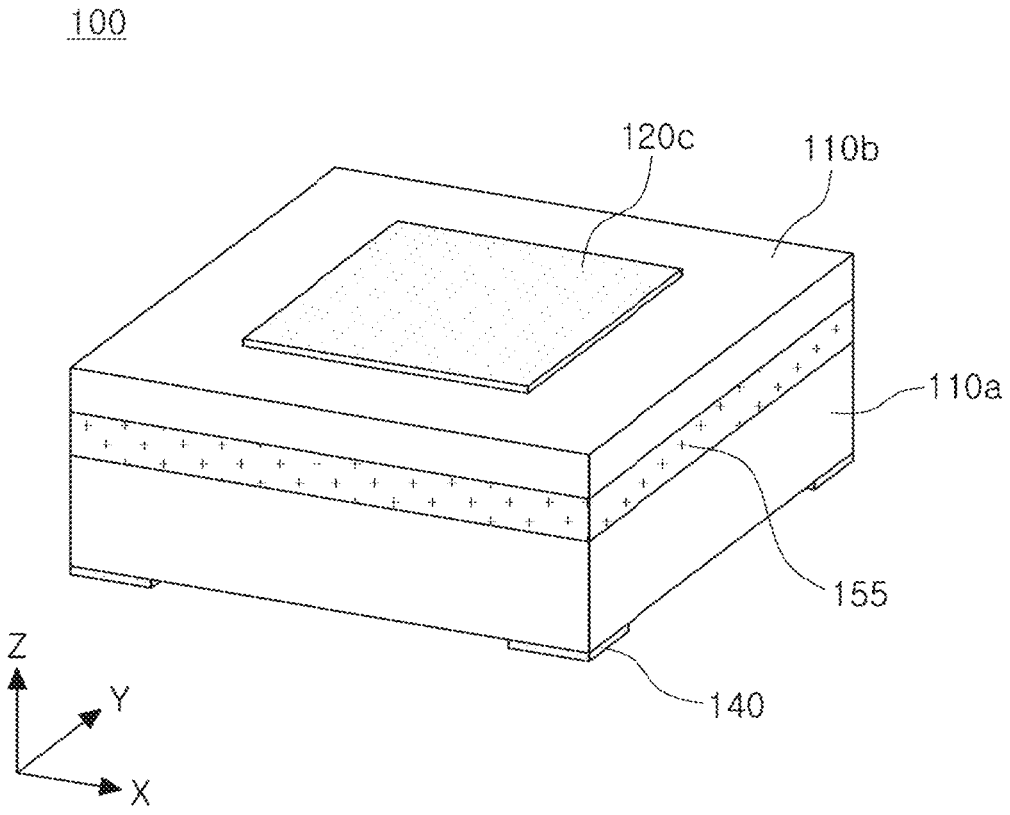
FIG. 8A illustrates a perspective view of an example chip antenna according to a second example.
Figure 8B:
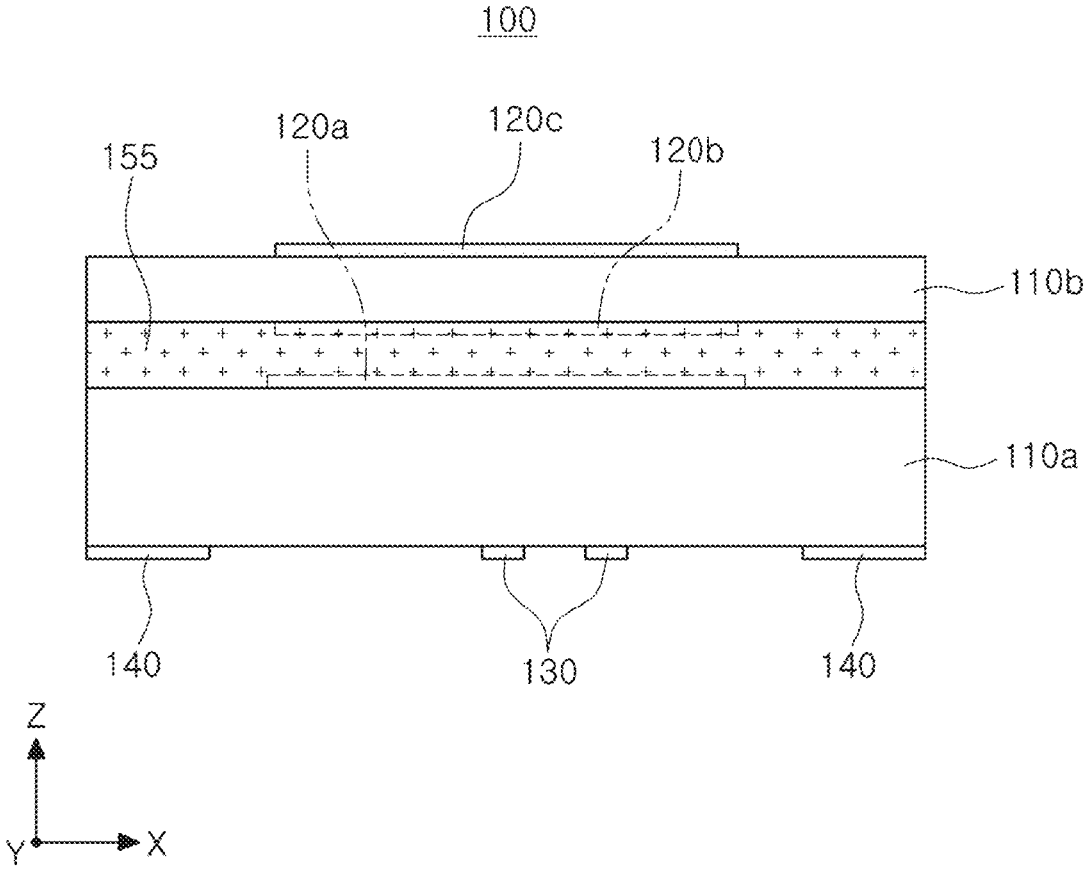
FIG. 8B illustrates a side view of the example chip antenna in FIG. 8A.
Figure 8C:
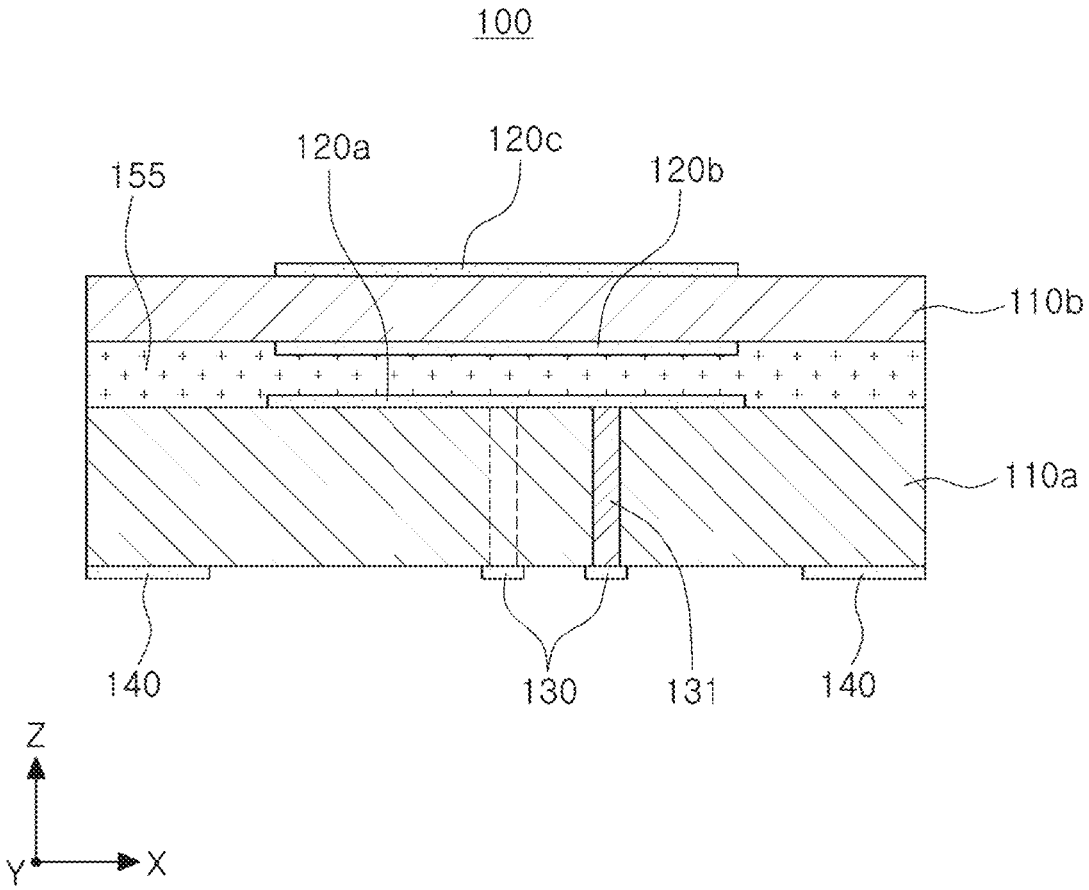
FIG. 8C illustrates a cross-sectional view of the example chip antenna in FIG. 8A.

FIG. 8A illustrates a perspective view of a chip antenna according to a second example, FIG. 8B is a side view of the chip antenna in FIG. 8A, and FIG. 8C is a cross-sectional view of the chip antenna in FIG. 8A. Since the chip antenna according to the second example is similar to the chip antenna according to the first example, duplicate descriptions will be omitted and descriptions will focus on differences therebetween.

The first substrate 110*a* and the second substrate 110*b* of the chip antenna 100 according to the first example are arranged to be spaced apart from each other through the spacer 150, while the first substrate 110*a* and the second substrate 110*b* of the chip antenna 100 according to the second example may be bonded to each other through the bonding layer 155. The bonding layer 155 of the second example may be construed to be provided in a space formed by a gap between the first substrate 110*a* and the second substrate 110*b* of the first example.

The bonding layer 155 may be formed to cover a first surface of the first substrate 110*a* and a second surface of the second substrate 110*b*, and thus, may entirely bond the first substrate 110*a* and the second substrate 110*b*. As an example, the bonding layer 155 may be formed of polymer, but is not limited thereto. As an example, the polymer may include a polymer sheet. The bonding layer 155 may have a dielectric constant lower than a dielectric constant of the first substrate 110*a* and the second substrate 110*b*. As an example, the bonding layer 155 may have a dielectric constant of 2 to 3 at 28 GHz and a thickness of 50 μm to 200 μm.

FIGS. 9A to 9F illustrates process diagrams of a method of manufacturing the chip antenna according to the second example.

Figure 9A:
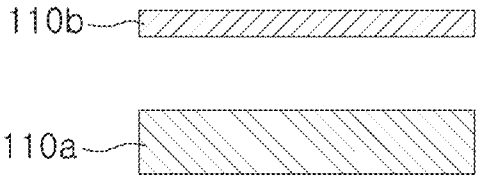
FIGS. 9A to 9F illustrate process diagrams of a method of manufacturing the example chip antenna according to the second example.
Figure 9B:
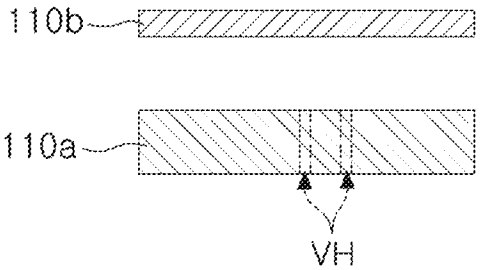
Figure 9C:
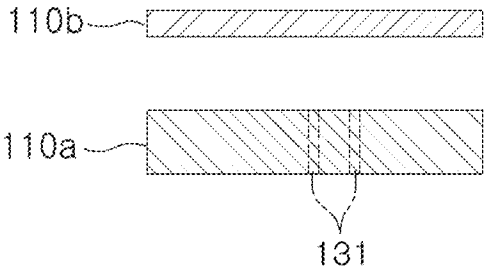

Referring to FIGS. 9A to 9F, a method of manufacturing a chip antenna according to an example starts in FIG. 9A where a first substrate 110*a* and a second substrate 110*b* are provided. Then, in FIG. 9B, a via hole VH is formed to penetrate through the first substrate 110*a* in a thickness direction, and in FIG. 9C, a conductive paste is applied to, or fills, the via hole VH. Thus, a feed via 131 is formed. The conductive paste may fill the entire via hole VH, or may be applied to an internal surface of the via hole VH to have a predetermined thickness.

Figure 9D:
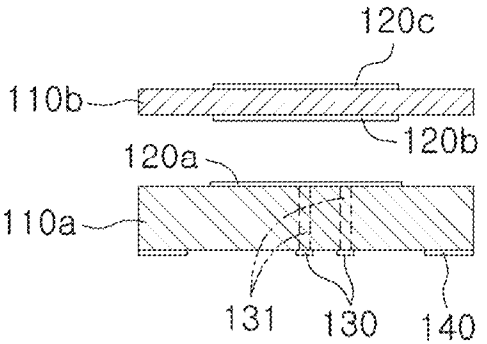

Referring to FIG. 9D, after the feed via 131 is formed, the conductive paste or conductive epoxy is printed and cured on the first substrate 110*a* and the second substrate 110*b* to form a first patch 120*a* on a first surface of the first substrate 110*a*, a feeding pad 130 and a bonding pad 140 are formed on a second surface of the first substrate 110*a*, and a second patch 120*b* is formed on a second surface of the second substrate 110*b*, and a third patch 120*c* is formed on a first surface of the second substrate 110*b*. Then, a protective layer is formed on the first patch 120*a*, the second patch 120*b*, the third patch 120*c*, the feeding pad 130, the feed via 131, and the bonding pad 140 by implementing a plating process. The protective layer may prevent oxidation of the first patch 120*a*, the second patch 120*b*, the third patch 120*c*, the feeding pad 130, the feed via 131, and the bonding pad 140.

Figure 9E:
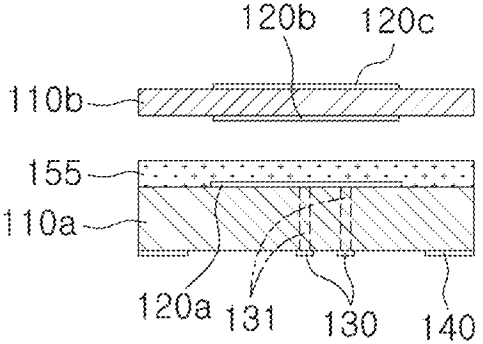

Referring to FIG. 9E, after the protective layer is formed, the bonding layer 155 is formed to cover a first surface of the first substrate 110*a*.

Figure 9F:
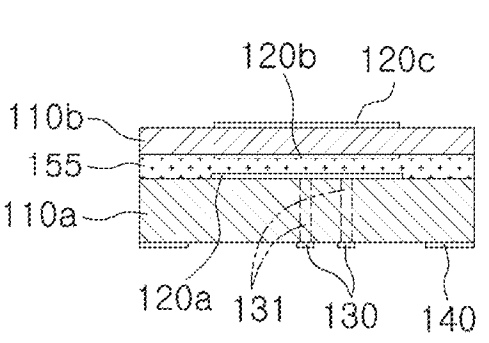

Referring to FIG. 9F, after the bonding layer 155 is formed, the second substrate 110*b* and the first substrate 110*a* are pressed. After the bonding layer 155 is cured, a plurality of integrally formed chip antennas may be divided by implementing a cutting process to manufacture individual chip antennas.

Figure 10A:
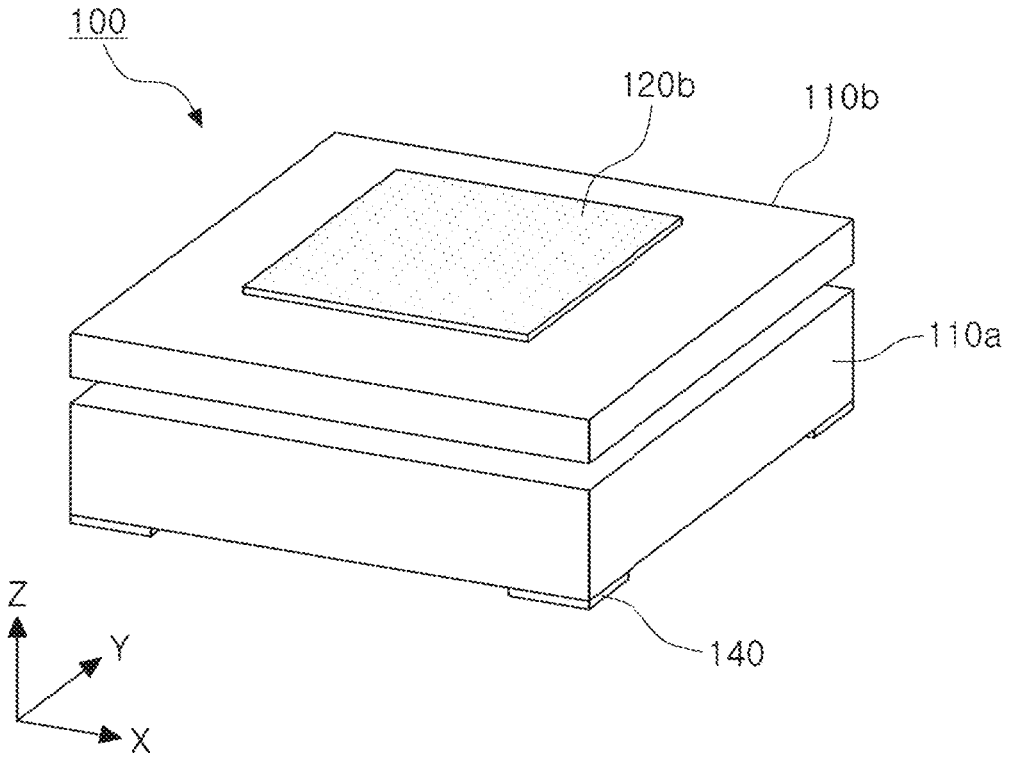
FIG. 10A illustrates a perspective view of an example chip antenna according to a third example.
Figure 10B:
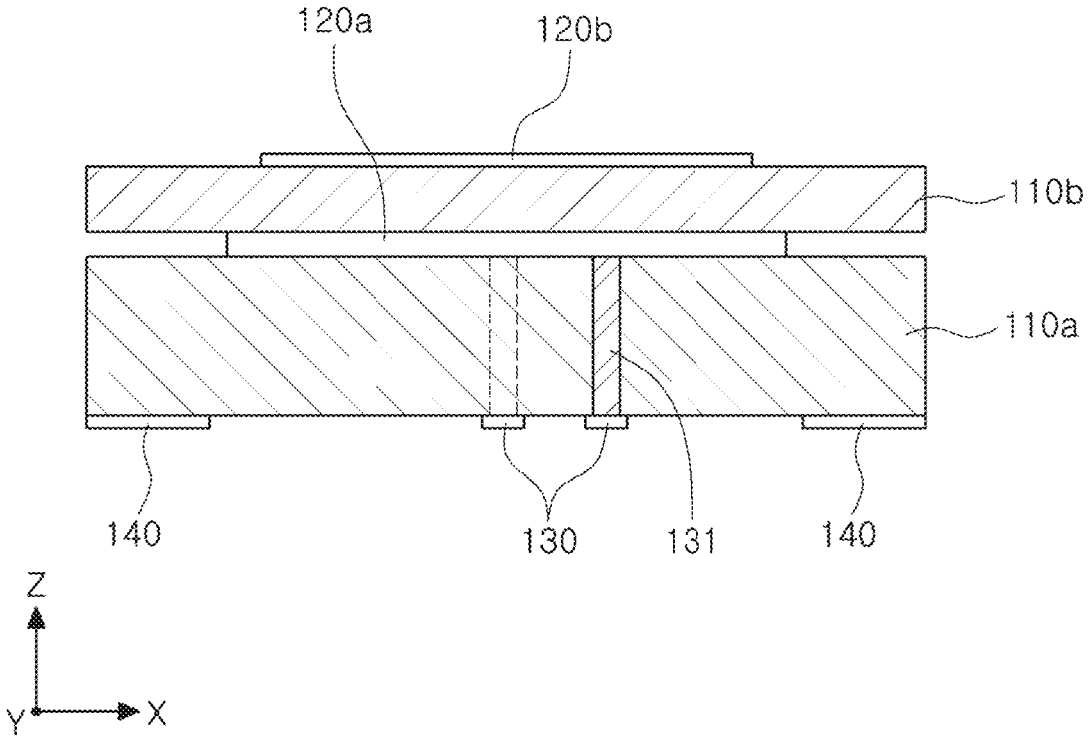
FIG. 10B illustrates a cross-sectional view of the example chip antenna in FIG. 10A.

FIG. 10A is a perspective view of a chip antenna according to a third example, and FIG. 10B is a cross-sectional view of the chip antenna in FIG. 10A. Since the chip antenna according to the third example is similar to the chip antenna according to the first example, duplicate descriptions will be omitted and descriptions will focus on differences therebetween.

The first substrate 110*a* and the second substrate 110*b* of the chip antenna 100 according to the first example are arranged to be spaced apart from each other through a spacer 150, whereas a first substrate 110*a* and the second substrate 110*b* of the chip antenna 100 according to the third example may be bonded to each other with a first patch 120*a* interposed therebetween.

Specifically, the first patch 120*a* may be provided on a first surface of the first substrate 110*a*, and the second patch 120*b* may be provided on a first surface of the second substrate 110*b*. The first patch 120*a*, provided on the first surface of the first substrate 110*a*, may be bonded to the second surface of the second substrate 110*b*. Accordingly, the first patch 120*a* may be interposed between the first substrate 110*a* and the second substrate 110*b*.

FIGS. 11A to 11E illustrate process diagrams of a method of manufacturing the chip antenna according to the third example.

Figure 11A:
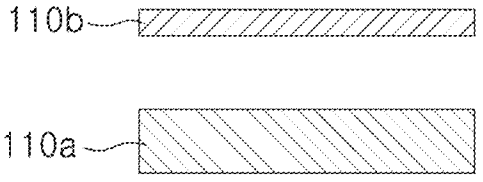
FIGS. 11A to 11E illustrate process diagrams of a method of manufacturing the example chip antenna according to the third example.
Figure 11B:
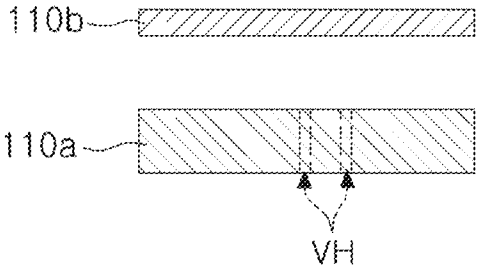
Figure 11C:
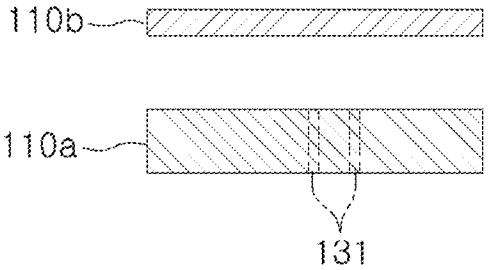

Referring to FIG. 11A, a method of manufacturing a chip antenna according to an example starts with a first substrate 110*a* and a second substrate 110*b* being provided. Then, in FIG. 11B, a via hole VH is formed to penetrate through the first substrate 110*a* in a thickness direction, and in FIG. 11C, a conductive paste is applied to, or fills, the via hole VH to form a feed via 131. The conductive paste may fill the entire via hole VH, or may be applied to an internal surface of the via hole VH to have a predetermined thickness.

Figure 11D:
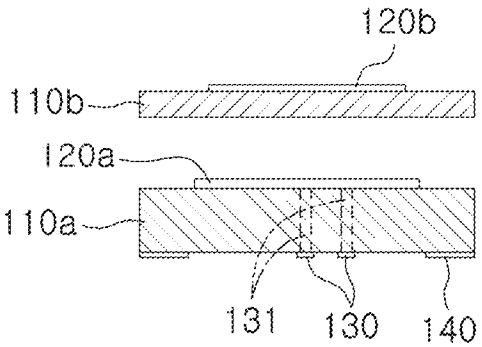

Referring to FIG. 11D, after the feed via 131 is formed, the conductive paste or conductive epoxy is printed and cured on the first substrate 110*a* and the second substrate 110*b* to form a first patch 120*a* on a first surface of the first substrate 110*a*, a feeding pad 130 and a bonding pad 140 are formed on the second surface of the first substrate 110*a*, and a second patch 120*b* is formed on a first surface of the second substrate 110*b*.

Figure 11E:
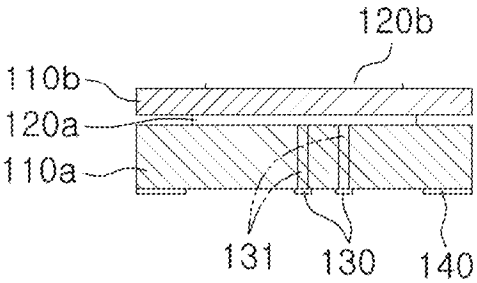

Then, referring to FIG. 11E, the conductive paste or the conductive epoxy is additionally printed one or more times on an area in which the first patch 120*a* is formed, and the second substrate 110*b* is pressed with the first patched 120*a* before the additionally printed conductive paste or the conductive epoxy is cured. After the first patch 120*a* is cured, a protective layer is formed on the second patch 120*b*, the feeding pad 130, the feed via 131, and the bonding pad 140 by implementing a plating process. The protective layer may prevent oxidation of the second patch 120*b*, the feeding pad 130, the feed via 131, and the bonding pad 140. Then, a plurality of integrally formed chip antennas may be divided by implementing a cutting process to manufacture individual chip antennas.

Figure 12:
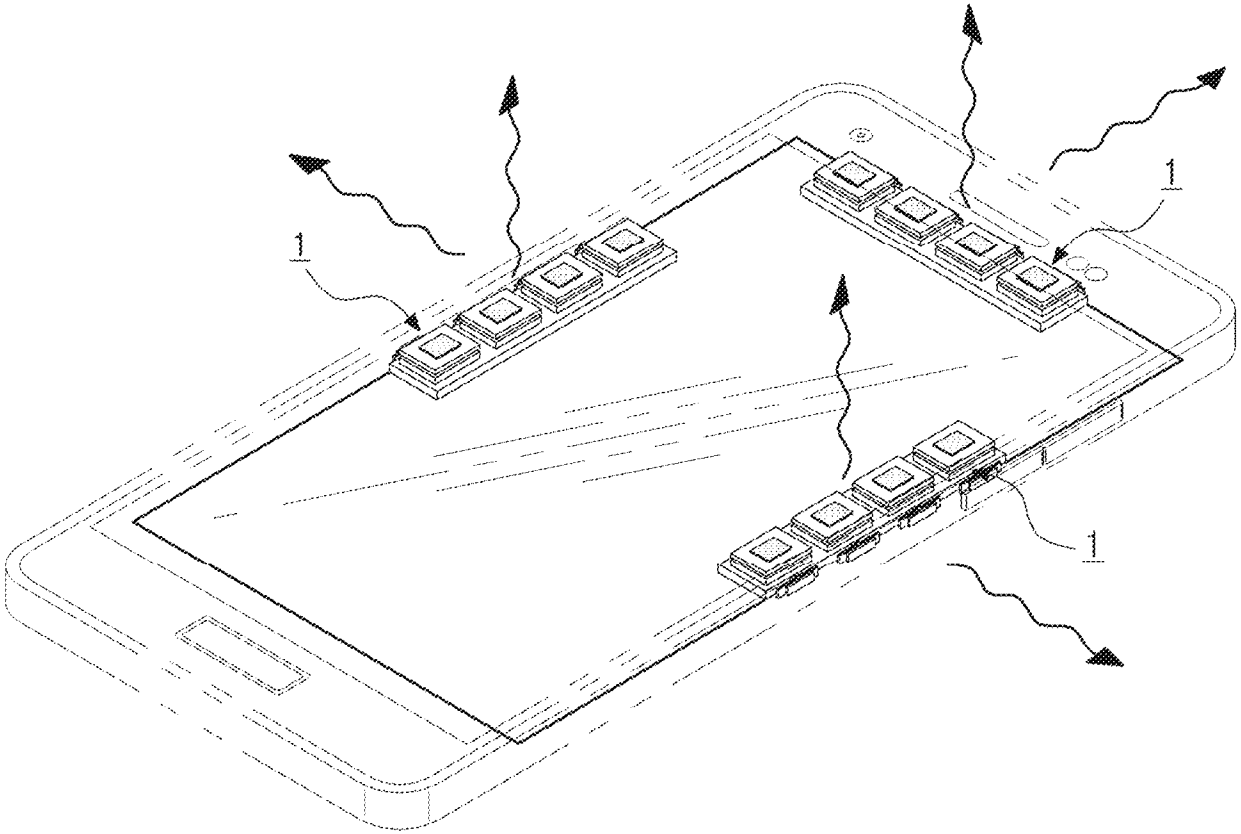
FIG. 12 illustrates a perspective view of a portable terminal on which chip antenna modules according to an example are mounted.

FIG. 12 illustrates a perspective view of a portable terminal on which chip antenna modules according to an example are mounted.

Referring to FIG. 12, a chip antenna module 1 according to an example may be disposed adjacent to an edge of a portable terminal. For example, the chip antenna module 1 may be disposed to face a side of the portable terminal in a length direction, or a side of the portable terminal in a width direction. In the present example, it is set forth that a chip antenna module is provided on both sides of the portable terminal in a length direction and one side of the portable terminal in a width direction. The present example is not limited thereto and, when an internal space of the portable terminal is insufficient, as necessary, a disposition structure of the chip antenna module may be changed to have various shapes such as a structure in which only two chip antenna modules are disposed in a diagonal direction of the portable terminal, or the like. An RF signal, radiated through the chip antenna of the chip antenna module 1, is radiated in a thickness direction of the mobile terminal. An RF signal, radiated through an end-fire antenna of the chip antenna module 1, may be radiated in a direction perpendicular to a side of the portable terminal in the length direction or a side of the portable terminal in the width direction.

According to an example, a patch antenna, implemented in a typical pattern form in a multilayer substrate, may be implemented in a chip form to significantly reduce the number of layers of a substrate on which a chip antenna is mounted. The manufacturing costs and volume of the chip antenna module may be reduced.

According to an example, in a substrate of a chip antenna, a dielectric constant may be effectively adjusted. Furthermore, losses of the chip antenna may be reduced to improve characteristics of an antenna.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A chip antenna comprising:

a first substrate;

a second substrate overlapping the first substrate;

a first patch, provided on a first surface of the first substrate;

a second patch, provided on the second substrate;

at least one feed via penetrating through the first substrate in a thickness direction and configured to provide a feed signal to the first patch; and a ground pad provided on a second surface of the first substrate, wherein the first substrate comprises a ceramic sintered material, and wherein the ceramic sintered material comprises an $Mg_2SiO_4$ phase, an $MgAl_2O_4$ phase, and a $CaTiO_3$ phase, and a content of the $CaTiO_3$ phase in the ceramic sintered material ranges from 5.1 mol % to 15.1 mol %.

2. The chip antenna of claim 1, wherein the first patch is a feed patch, and the second patch is a radiation patch.

3. The chip antenna of claim 1, wherein the first substrate has a dielectric constant of 7.5 to 15.6 at 28 GHz.

4. The chip antenna of claim 1, wherein the ceramic sintered material is a sintered material of a mixture of MgO particles, $SiO_2$ particles, $Al_2O_3$ particles, and $CaTiO_3$ particles.

5. The chip antenna of claim 4, wherein a content of the $CaTiO_3$ particles in the mixture ranges from 12% by weight to 33% by weight.

6. The chip antenna of claim 5, wherein a content of the MgO particles in the mixture ranges from 38.5 mol % to 50.2 mol %.

7. The chip antenna of claim 5, wherein a content of the $SiO_2$ particles in the mixture ranges from 28.0 mol % to 35.6 mol %.

8. The chip antenna of claim 5, wherein a content of the $Al_2O_3$ particles in the mixture ranges from 7.0 mol % to 9.1 mol %.

9. The chip antenna of claim 1, wherein the second substrate is formed of a same material as the first substrate.

10. The chip antenna of claim 1, wherein a thickness of the first substrate corresponds to two to three times a thickness of the second substrate.

11. The chip antenna of claim 1, wherein the first substrate has a thickness of 150 μm to 500 μm.

12. The chip antenna of claim 1, wherein the second substrate has a thickness of 50 μm to 200 μm.

13. The chip antenna of claim 1, further comprising:

a spacer disposed between the first substrate and the second substrate.

14. The chip antenna of claim 1, further comprising:

a bonding layer disposed between the first substrate and the second substrate.

15. The chip antenna of claim 14, wherein the bonding layer has a dielectric constant lower than a dielectric constant of the first substrate and a dielectric constant of the second substrate.

* * * * *